US007847758B2

(12) United States Patent
Itakura et al.

(10) Patent No.: US 7,847,758 B2
(45) Date of Patent: Dec. 7, 2010

(54) PLASMA DISPLAY PANEL DRIVING METHOD

(75) Inventors: Shunsuke Itakura, Chuo (JP); Tsutomu Tokunaga, Chuo (JP)

(73) Assignee: Panasonic Corporation, Osaka (JP)

( * ) Notice: Subject to any disclaimer, the term of this patent is extended or adjusted under 35 U.S.C. 154(b) by 664 days.

(21) Appl. No.: 11/924,165

(22) Filed: Oct. 25, 2007

(65) Prior Publication Data

US 2008/0129656 A1 Jun. 5, 2008

(30) Foreign Application Priority Data

Oct. 26, 2006 (JP) ..... 2006-291274

(51) Int. Cl.
*G09G 3/28* (2006.01)

(52) U.S. Cl. ..... 345/60; 345/63; 345/67; 345/68

(58) Field of Classification Search ..... 345/60, 345/63, 67, 68
See application file for complete search history.

(56) References Cited

U.S. PATENT DOCUMENTS 6,278,422 B1 * 8/2001 Ukai et al. ..... 345/63
6,614,413 B2 * 9/2003 Tokunaga et al. ..... 345/63
6,724,356 B1 * 4/2004 Kojima et al. ..... 345/60
7,355,568 B2 * 4/2008 Homma ..... 345/60
7,466,292 B2 * 12/2008 Kojima et al. ..... 345/60
7,525,513 B2 * 4/2009 Yoon et al. ..... 345/60

FOREIGN PATENT DOCUMENTS

JP 2006-54160 A 2/2006

* cited by examiner

*Primary Examiner*—Richard Hjerpe
*Assistant Examiner*—Sahlu Okebato
(74) *Attorney, Agent, or Firm*—Sughrue Mion, PLLC

(57) ABSTRACT

A plasma display panel driving method in which a reset step and an address step are sequentially executed in the first subfield and second subfield of each field. A microemission step is executed in the first subfield for generating a microemission discharge between ones of the row electrodes and the column electrodes in display cells in the ON mode by applying a voltage for using the ones of the row electrodes as the anode and the column electrodes as the cathode, between the electrodes immediately after the address step. Moreover, in the microemission step, a potential lower than the voltage generated when applying a sustain pulse is respectively applied to the ones and the others of the row electrodes while applying a voltage as described above between the ones of the row electrodes and the column electrodes.

19 Claims, 13 Drawing Sheets

○ PHOSPHOR PARTICLES

⊠ MgO CRYSTALS
(INCLUDING CL LUMINESCENCE MgO CRYSTALS)

FIG. 6

GRAY SCALE DRIVING

DISPLAY LUMINANCE

| | DATA CONVERSION TABLE | | | | | | | | | | | | | | | LUMINESCENCE PATTERNS | | | | | | | | | | | | | | | |
|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST GRADATION | 0000 | 0 | 0 | 0 | 0 | 0 | 0 | 0 | 0 | 0 | 0 | 0 | 0 | 0 | 0 | | | | | | | | | | | | | | | 0 |
| 2ND GRADATION | 0001 | 1 | 0 | 0 | 0 | 0 | 0 | 0 | 0 | 0 | 0 | 0 | 0 | 0 | 0 | □ | | | | | | | | | | | | | | α |
| 3RD GRADATION | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4TH GRADATION | 0011 | 1 | 1 | 1 | 0 | 0 | 0 | 0 | 0 | 0 | 0 | 0 | 0 | 0 | 0 | □ | ◎ | ● | | | | | | | | | | | | 1+α |
| 5TH GRADATION | 0100 | 1 | 1 | 0 | 1 | 0 | 0 | 0 | 0 | 0 | 0 | 0 | 0 | 0 | 0 | □ | ◎ | ○ | ● | | | | | | | | | | | 3+α |
| 6TH GRADATION | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | 9+α |
| 7TH GRADATION | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | 17+α |
| 8TH GRADATION | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | 27+α |
| 9TH GRADATION | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | 39+α |
| 10TH GRADATION | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | 55+α |
| 11TH GRADATION | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | 77+α |
| 12TH GRADATION | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | 103+α |
| 13TH GRADATION | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | 133+α |
| 14TH GRADATION | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | 169+α |
| 15TH GRADATION | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | 209+α |
| 16TH GRADATION | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | 255+α |

□ : WRITING ADDRESS DISCHARGE + MICROEMISSION DISCHARGE

○ : SUSTAIN DISCHARGE LUMINESCENCE

◎ : WRITING ADDRESS DISCHARGE + SUSTAIN DISCHARGE LUMINESCENCE

● : ERASE ADDRESS DISCHARGE $\alpha < 1$

PLASMA DISPLAY PANEL DRIVING METHOD

BACKGROUND OF THE INVENTION

1. Field of the Invention

The present invention relates to a method for driving a plasma display panel.

2. Description of the Related Art

AC (alternating current) plasma display panels (to be referred to as PDP) are currently commercially available for use as thin display devices. A PDP houses two substrates consisting of a front transparent substrate and a rear substrate arranged in mutual opposition and separated by a predetermined gap. A plurality of row electrode pairs mutually forming pairs and respectively extending in the horizontal direction of the screen are formed on the inner surface of the front transparent substrate (surface opposing the rear substrate) serving as the display surface. Moreover, a dielectric layer covering each row electrode pair is formed on the inner surface of the front transparent substrate. A plurality of column electrodes extending in the vertical direction of the screen so as to intersect the row electrode pairs are formed on the rear substrate. When viewed from the display surface, display cells corresponding to pixels are formed at the intersections of the row electrode pairs and column electrodes.

Grayscale driving using a subfield method is carried out for this type of PDP so as to obtain half-tone display luminance corresponding to an input video signal.

In grayscale driving using a subfield method, display driving for one field's worth of a video signal is carried out for each of a plurality of subfields to which a number of times (or time period) light is to be emitted has respectively been assigned. In each subfield, an address step and a sustain step are carried out sequentially. In the address step, a selective discharge is selectively induced between the row electrodes and column electrodes in each display cell corresponding to an input video signal to form (or delete) a predetermined amount of wall charge. In the sustain step, only those display cells in which a predetermined amount of wall charge has been formed are made to discharge repeatedly to maintain a luminescent state accompanying that discharge. Moreover, a reset step is carried out prior to the address step in at least the first subfield. In this reset step, the amounts of wall charge remaining in all display cells are initialized by inducing a reset discharge between the pairs of row electrodes in all display cells.

Here, since the reset discharge is a comparatively strong discharge and is not involved in any manner with the contents of the image to be displayed, there was the problem of luminescence accompanying this discharge lowering image contrast.

Therefore, a PDP and driving method thereof have been proposed in which discharge delay time is attempted to be shortened by adhering magnesium oxide crystals, which exhibit cathode luminescence having a peak within a wavelength of 200 to 300 nm as a result of being excited by electron beam irradiation, to the surface of a dielectric layer covering row electrode pairs. For example, Japanese Patent Kokai No. 2006-54160 (Patent Document 1) discloses this PDP and its driving method. According to this PDP, since priming effects following discharge are made to persist for a comparatively long period of time, a weak discharge can be generated with stability. Therefore, by applying a reset pulse having a pulse waveform, in which the voltage value gradually reaches a peak voltage value with the passage of time, to the row electrodes of a PDP as described above, a weak reset discharge is made to occur between mutually adjacent row electrodes. In this process, since the emission luminance accompanying reset discharge decreases as a result of weakening this discharge, image contrast can be enhanced.

However, since it is not possible to adequately enhance so-called black contrast when displaying dark images even by using a driving method like that described above, there was the problem of being unable to provide dark images with high image quality.

SUMMARY OF THE INVENTION

An object of the present invention is to provide a driving method of a plasma display panel capable of enhancing the ability to express luminance contrast when displaying dark images.

A driving method for a plasma display panel according to a first aspect of the present invention is a method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, the method comprising: sequentially executing a reset step, in which the display cells are initialized to a state of an OFF mode by generating a reset discharge between ones of the row electrodes of the row electrode pairs and the column electrodes within the display cells by applying a voltage for using ones of the row electrodes as the anode and the column electrodes as the cathode, between the ones of the row electrodes and the column electrodes, and an address step, in which the display cells are changed to a state of an ON mode by causing the display cells to selectively address discharge, corresponding to the pixel data, said reset step and said address step being executed in at least a first subfield and a second subfield immediately following the first subfield when a display period of a single field in the video signal is divided into a plurality of subfields; executing a sustain step that causes a sustain discharge in only the display cells in the state of the ON mode by alternately applying a sustain pulse to the ones of the row electrode pairs and the others of the row electrode pairs in each subfield subsequent to the second subfield; and executing a microemission step in which a microemission discharge is generated between the ones of the row electrodes and the column electrodes within the display cells in the state of the ON mode by applying a voltage, using the ones of the row electrodes as the anode and the column electrodes as the cathode, between the ones of the row electrodes and the column electrodes while respectively applying a potential lower than the voltage generated between the ones of the row electrodes and the others of the row electrodes to the ones of the row electrodes and the others of the row electrodes when applying the sustain pulse immediately after the address step in the first subfield.

In addition, a driving method for a plasma display panel according to another aspect of the present invention is a method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, and the method comprising: sequentially executing a reset step, in which the display cells are initialized to a state of an OFF mode by generating a reset discharge of the display cells, an address step, in which the display cells are changed to a state of an ON mode by causing the display cells to selectively address discharge corresponding to the pixel data, and a microemission step, in which the display cells in the state of the ON mode are caused to microemission discharge, said reset step, said address step and said microemission step being executed in a first subfield when a display period of a single field in the video signal is divided into a plurality of subfields; wherein, in the reset step, the reset discharge is generated between ones of the row electrodes of the row electrode pairs and the column electrodes by applying a voltage, using the ones of the row electrodes as the anode and the column electrodes as the cathode, between the ones of the row electrodes and the column electrodes, and in the microemission step, together with generating the microemission discharge between the column electrodes and the ones of the row electrodes in the display cells in the state of the ON mode by applying a voltage, using the ones of the row electrodes as the anode and the column electrodes as the cathode, between the ones of the row electrodes and the column electrodes, a potential of the same polarity as a potential applied to the ones of the row electrodes is applied to the other row electrodes of the row electrode pairs.

A plasma display panel, in which display cells are formed at each intersection of a plurality of row electrode pairs formed on a first substrate and a plurality of column electrodes formed on a second substrate, the first substrate and second substrate being arranged in mutual opposition with a discharge space, in which a discharge gas has been sealed, positioned there between, is driven in the manner described below. Namely, a reset step, in which each display cell is initialized to an off mode by generating a reset discharge between one of the row electrodes of the row electrode pairs and the column electrodes in all of the display cells in each first and second subfield of each field, and an address step, in which the display cells are changed to an on mode by causing the display cells to selectively address discharge corresponding to pixel data, are executed sequentially. In this process, a microemission step is executed immediately after the address step in the first subfield in which a microemission discharge is generated between ones of the row electrodes and column electrodes within those display cells in the state of the one mode by applying a voltage, using the ones of the row electrodes as the anode and the column electrodes as the cathode, between both electrodes. Since this microemission discharge is generated between ones of the row electrode pairs formed on the first substrate and column electrodes formed on the second substrate, the level of emission luminance accompanying a sustain discharge, which is generated between each row electrode (one row electrode, other row electrodes) serving as row electrode pairs formed only on the first substrate, is lower than that of sustain discharge.

Here, in the microemission step, potentials lower than the voltage generated between ones of the row electrodes and the others of row electrodes during application of a sustain pulse while applying a voltage as described above between ones of the row electrodes and the column electrodes, are respectively applied to the ones of the row electrodes and the others of the row electrodes so as to prevent erroneous discharge between each of the row electrodes serving as row electrode pairs.

Accordingly, according to this form of driving, since a microemission discharge having a low emission luminance accompanying a sustain discharge in comparison with that sustain discharge can be reliably generated, differences in luminance between each gradation expressing low luminance can be minimized, thereby enhancing the ability to express luminance contrast when expressing dark images.

BRIEF DESCRIPTION OF THE DRAWINGS

FIG. 6 shows luminescence patterns of each gradation;

DETAILED DESCRIPTION OF THE INVENTION

Figure 1:
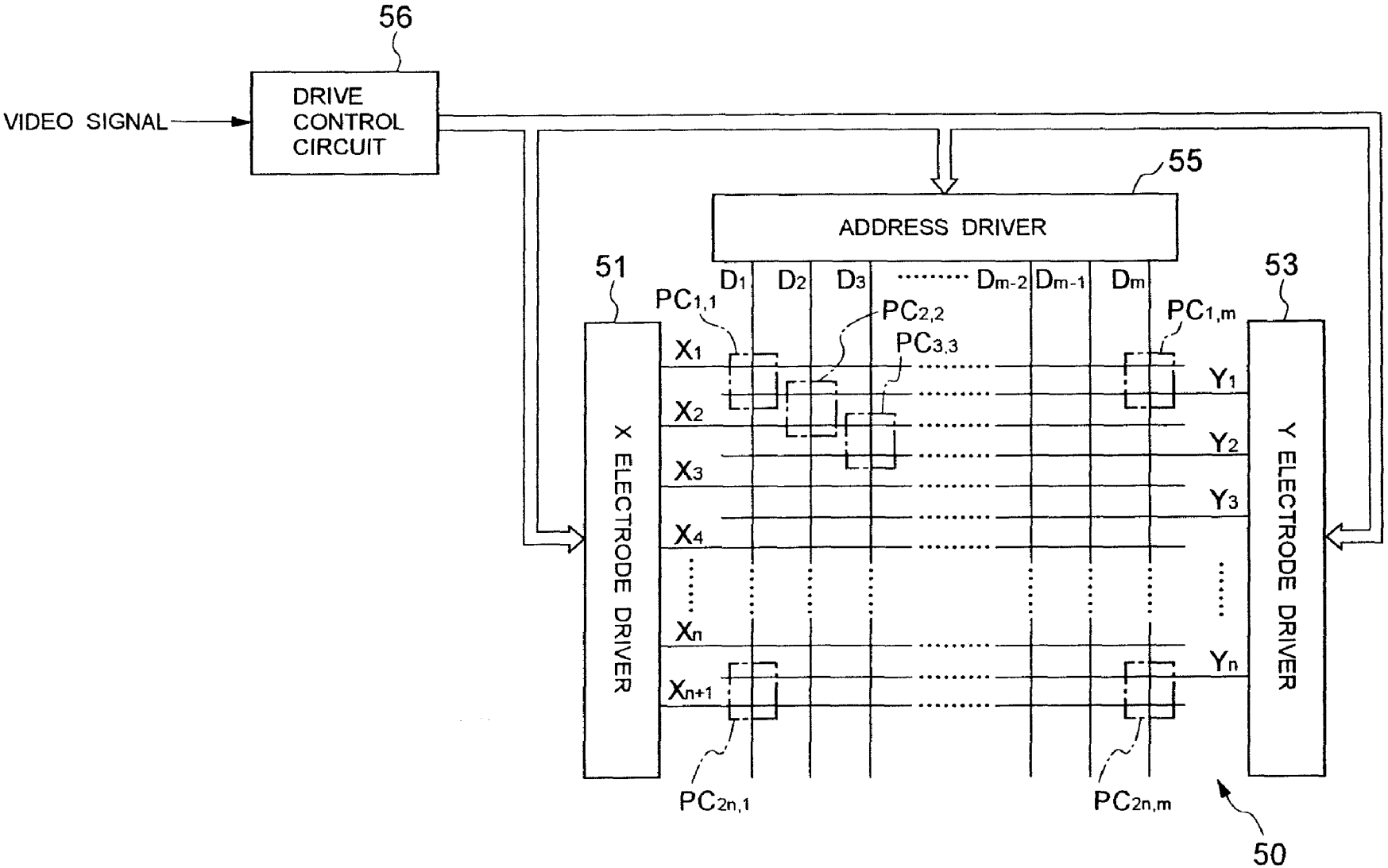
FIG. 1 schematically shows the constitution of a plasma display device according to the present invention.

FIG. 1 schematically shows the constitution of a plasma display device in which a plasma display panel is driven according to the driving method according to the present invention.

As shown in FIG. 1, this plasma display device is composed of a plasma display panel in the form of a PDP 50, an X electrode driver 51, a Y electrode driver 53, an address driver 55, and a driving control circuit 56.

Column electrodes $D_1$ to $D_m$ each arranged extending in the longitudinal direction (vertical direction) of a two-dimensional display screen, and row electrodes $X_1$ to $X_n$ and row electrodes $Y_1$ to $Y_n$, each arranged extending in the lateral direction (horizontal direction), are formed in the PDP 50. Row electrode pairs forming a pair with mutually adjacent row electrodes $(Y_1,X_1)$, $(Y_2,X_2)$, $(Y_3,X_3)$, . . . $(Y_n,X_n)$ respectively serve as a first display line to an nth display line in the PDP 50. A discharge cell (display cell) PC serving as a pixel is formed at the respective intersections of each display line and each column electrode D1 to Dm (areas surrounded with alternating long and short dashed lines in FIG. 1). Namely, the PDP 50 has discharge cells $PC_{1,1}$ to $PC_{1,m}$ belonging to a first display line, discharge cells $PC_{2,1}$ to $PC_{2,m}$ belonging to a second display line, and . . . discharge cells $PC_{n,1}$ to $PC_{n,m}$ belonging to an nth display line respectively arranged in the form of a matrix.

Figure 2:
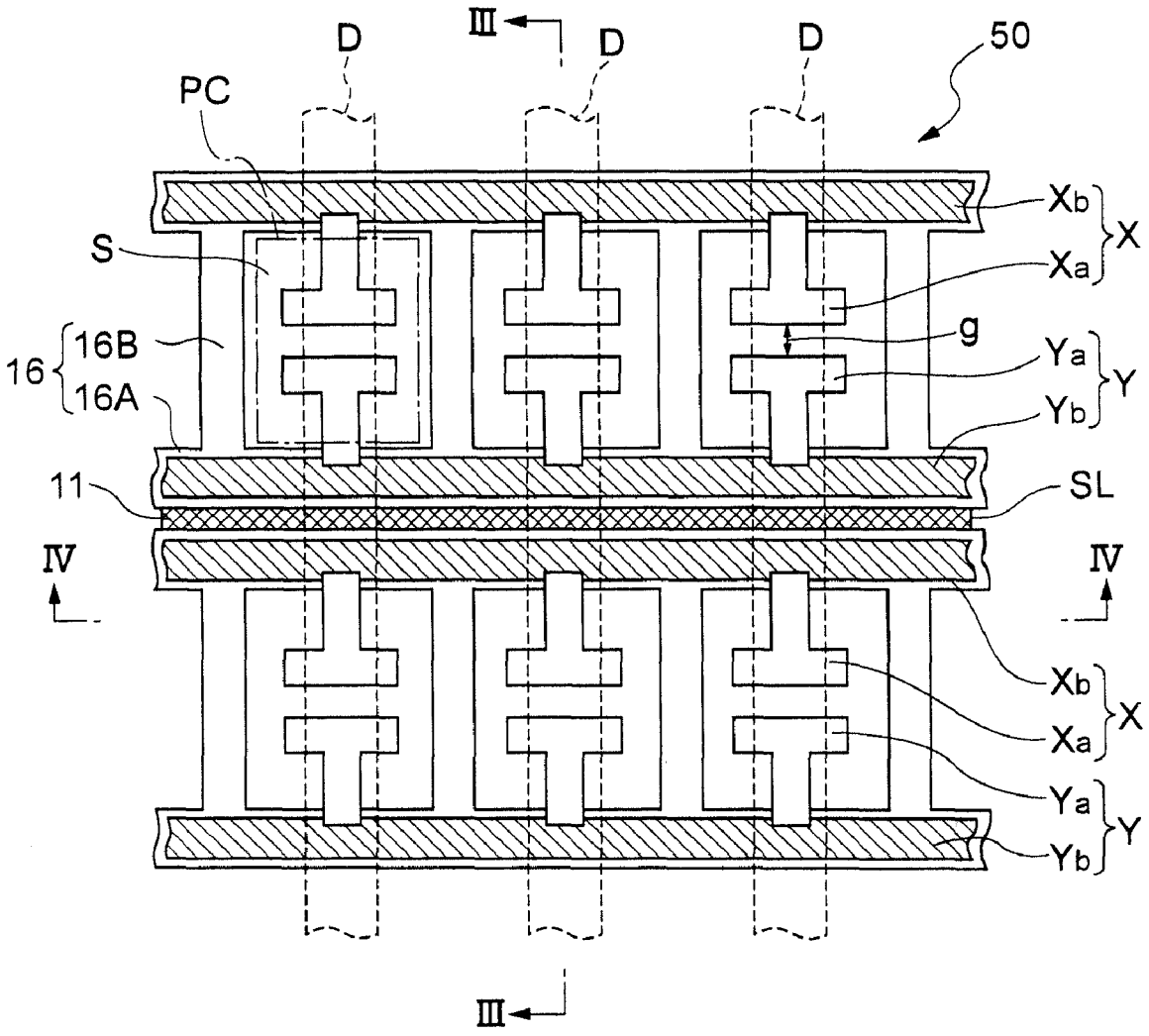
FIG. 2 is a front view schematically showing the internal structure of a PDP 50 as viewed from the display side.
Figure 3:
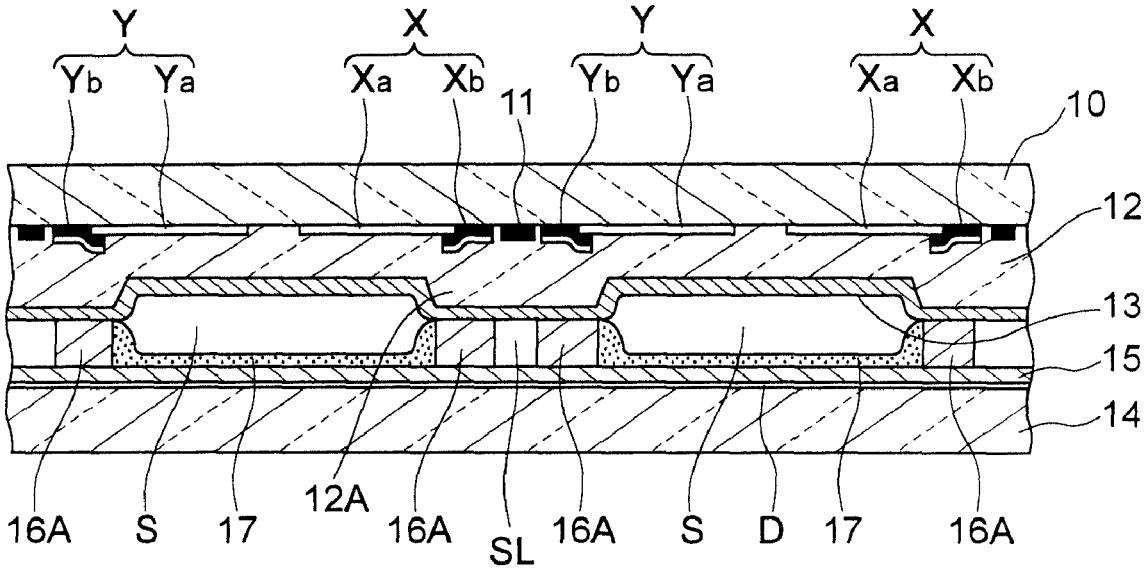
FIG. 3 is a cross-sectional view taken along line III-III shown in FIG. 2.
Figure 4:
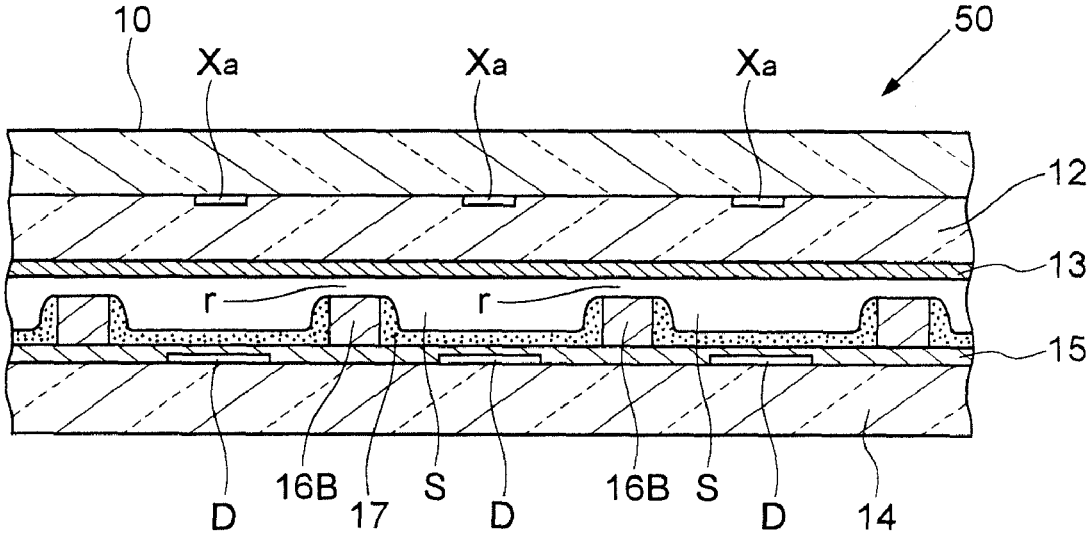
FIG. 4 is a cross-sectional view taken along line IV-IV shown in FIG. 2.

FIG. 2 is a front view schematically showing the internal structure of the PDP 50 as viewed from the display side. Furthermore, in FIG. 2, the internal structure is shown by extracting each intersection between three respectively adjacent column electrodes D and two mutually adjacent display lines. In addition, FIG. 3 is a cross-sectional view of the PDP 50 taken along line III-III of FIG. 2, while FIG. 4 is a cross-sectional view of the PDP 50 taken along line IV-IV of FIG. 2.

As shown in FIG. 2, each row electrode X is composed of a bus electrode Xb extending in the horizontal direction of a two-dimensional display screen, and T-shaped transparent electrodes Xa provided in respective contact at locations corresponding to each discharge cell PC on the bus electrode Xb. Each row electrode Y is composed of a bus electrode Yb extending in the horizontal direction of a two-dimensional display screen, and T-shaped transparent electrodes Ya provided in respective contact at locations corresponding to each discharge cell PC on the bus electrode Yb. The transparent electrodes Xa and Ya are composed of a transparent conductive film made of, for example, ITO, while bus electrodes Xb and Yb are composed of, for example, a metal film. As shown in FIG. 3, row electrodes X composed of transparent electrodes Xa and bus electrode Xb and row electrodes Y composed of transparent electrodes Ya and bus electrode Yb are formed on the back of a front transparent substrate 10 of which the front side serves as the display surface of the PDP 50. At this time, transparent electrodes Xa and Ya in each row electrode pair (X,Y) extend towards the partner row electrode with which they mutually form a pair, and the corresponding tips of the wide portions thereof are mutually opposed separated by a discharge gap g1 of a predetermined width. In addition, a black or dark-colored photoabsorbent layer (light blocking layer) 11 extending in the horizontal direction of the two-dimensional display screen is formed between the row electrode pairs (X,Y) and row electrode pairs (X,Y) adjacent thereto on the back of the front transparent substrate 10. Moreover, a dielectric layer 12 is formed on the back of the front transparent substrate 10 so as to cover the row electrode pairs (X,Y). As shown in FIG. 3, an augmented dielectric layer 12A is formed on the back of this dielectric layer 12 (side opposite from the side with which the row electrode pairs make contact) at a portion corresponding to photoabsorbent layer 11 and areas where bus electrodes Xb and Yb are formed adjacent to this photoabsorbent layer 11.

A magnesium oxide layer 13 is formed on the surfaces of the dielectric layer 12 and augmented dielectric layer 12A. Furthermore, magnesium oxide layer 13 contains a secondary electron releasing material, which demonstrates cathode luminescence (CL) having a peak within 200 to 300 nm, and particularly within 230 to 250 nm, as a result of being excited by irradiation with an electron beam, in the form of magnesium oxide crystals (to be referred to as CL luminescence MgO crystals). These CL luminescence MgO crystals are obtained by vapor phase oxidation of magnesium vapor generated by heating magnesium, and have, for example, a polycrystalline structure consisting of mutually interlocking cubic crystals or a cubic single crystal structure. The mean particle diameter of the CL luminescent MgO crystals is 2000 Angstroms or more (result of measurement using the BET method).

In the case of attempting to form magnesium single crystals by vapor phase oxidation having a large particle diameter in which the mean particle diameter of 2000 Angstroms or more, it is necessary to raise the heating temperature when generating magnesium vapor. Consequently, the length of the flame in which the magnesium and oxygen react becomes longer, and the temperature difference between the flame and the surroundings increases. As a result, a larger number of magnesium single crystals are formed having an energy level corresponding to the peak wavelength of CL luminescence as previously described (for example, that in the vicinity of 235 nm or within 230 to 250 nm) the larger the particle diameter of the magnesium oxide single crystals formed by vapor phase oxidation.

In addition, in comparison with typical vapor phase oxidation, vapor phase oxidation magnesium single crystals formed by increasing the amount of vaporized magnesium per unit time to increase the reaction zone between magnesium and allow the magnesium to react with more oxygen has an energy level corresponding to the peak wavelength of the CL luminescence.

A magnesium oxide layer 13 is formed by adhering these CL luminescence MgO crystals to the dielectric layer 12 by a method such as spraying or electrostatic coating. Furthermore, the magnesium oxide layer 13 may also be formed by forming a magnesium oxide thin film on the surface of the dielectric layer 12 by vapor deposition or sputtering, and then adhering CL luminescence MgO crystals thereon.

On the other hand, each column electrode D is formed on the rear substrate 14 arranged in parallel with the front transparent substrate 10 in a direction perpendicular to the row electrode pairs (X,Y) at those locations in opposition to transparent electrodes Xa and Ya in each row electrode pair (X,Y). A white column electrode protective layer 15 covering the column electrodes D is further formed on the rear substrate 14. A barrier 16 is formed on this column electrode protective layer 15. This barrier 16 is formed in the shape of a ladder by lateral walls 16A, which respectively extend in the lateral direction of a two-dimensional display screen at those locations corresponding to bus electrodes Xb and Yb of each row electrode pair (X,Y), and longitudinal walls 16B, which extend in the longitudinal direction of a two-dimensional display screen at each of the intermediate locations between mutually adjacent column electrodes D. Moreover, as shown in FIG. 2, this ladder-shaped barrier 16 is formed for each display line of the PDP 50. As shown in FIG. 2, a gap SL is present between mutually adjacent barriers 16. In addition, respectively independent discharge cells PC, containing a discharge space S and transparent electrodes Xa and Ya, are demarcated by ladder-shaped barriers 16. A discharge gas containing xenon gas is sealed within discharge space S. A phosphor layer 17 is formed on the sides of lateral walls 16A, sides of the longitudinal walls 16B and the surface of column electrode protective layer 15 in each discharge cell PC so as to cover all of these surfaces. This phosphor layer 17 is actually composed of three types of phosphors consisting of a phosphor for emitting red light, a phosphor for emitting green light and a phosphor for emitting blue light.

Figure 5:
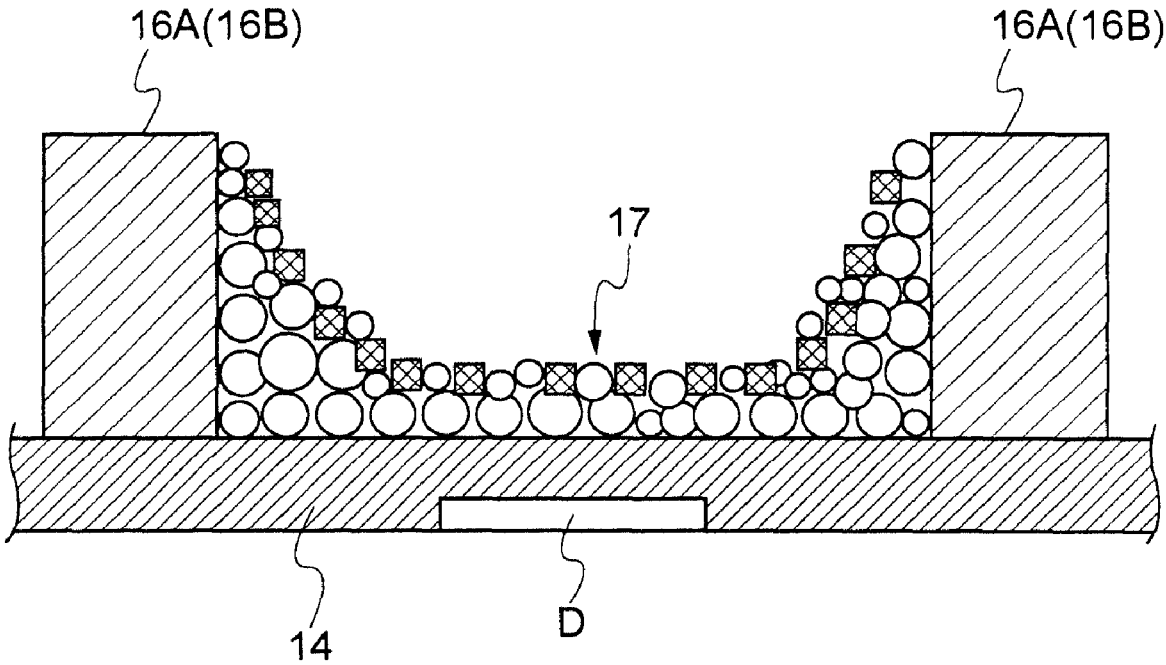
FIG. 5 is a schematic drawing of MgO crystals contained within a phosphor layer 17.

Furthermore, the phosphor layer 17 contains a secondary electron releasing material in the form of MgO crystals (including CL luminescence MgO crystals) in a form as shown in, for example, FIG. 5. At this time, the MgO crystals are exposed from the phosphor layer 17 at least on the surface of the phosphor layer 17, namely on the surface in contact with discharge space S, so as to contact the discharge gas.

Here, the magnesium oxide layer 13 is mutually enclosed between the discharge space S and gap SL of each discharge cell PC as a result of magnesium layer 13 being in contact with lateral walls 16A as shown in FIG. 3. In addition, as shown in FIG. 4, since longitudinal walls 16B are not in contact with the magnesium oxide layer 13, a gap r is present there between. Namely, each discharge space S of mutually adjacent discharge cells PC in the lateral direction of a two-dimensional display screen is mutually continuous through this gap r.

The driving control circuit 56 first converts an input video signal to 8-bit pixel data that represents all of the luminance levels of each pixel in 256 gradations, followed by performing multiple gradation processing comprising error diffusion processing and dither processing on this pixel data. Namely, in the initial error diffusion processing, the upper 6 bits of the pixel data are designated as display data, while the remaining lower 2 bits are designated as error data. The result of weighted addition of error data in the pixel data corresponding to each peripheral pixel is reflected in the display data to obtain 6 bits of error diffusion processing pixel data. According to this error diffusion processing, the luminance of the lower 2 bits in raw pixels is artificially expressed by peripheral pixels, thereby enabling expression of gradation luminance equivalent to the 8 bits of pixel data with fewer than 8 bits, and namely 6 bits, of display data. Next, the driving control circuit 56 performs dither processing on the 6 bits of error diffusion processing pixel data obtained by this error diffusion processing. In this dither processing, a plurality of mutually adjacent pixels are designated as a single pixel unit, and the error diffusion processing pixel data corresponding to each pixel in this single pixel unit is respectively assigned a dither coefficient comprised of mutually different coefficient values followed by addition of these dither coefficients to obtain dither addition pixel data. As a result of adding these dither coefficients, in the case of viewing in pixel units as previously described, luminance equivalent to 8 bits can be represented with only the upper 4 bits of dither addition pixel data. Therefore, as shown in FIG. 6, the upper 4 bits of the dither addition pixel data are converted to 4 bits of multiple gradation pixel data PDs that expresses all luminance levels with 16 gradations by the driving control circuit 56. The driving control circuit 56 then converts multiple gradation pixel data PDs to 14 bits of pixel driving data GD in accordance with a data conversion table as shown in FIG. 6. The driving control circuit 56 respectively correlates the 1st to 14th bits in this pixel driving data GD to each subfield SF1 to SF14 (to be described later), and supplies the bit digit corresponding to that subfield SF to the address driver 55 one display line (m bits) at a time in the form of pixel driving data bits.

Figure 7:
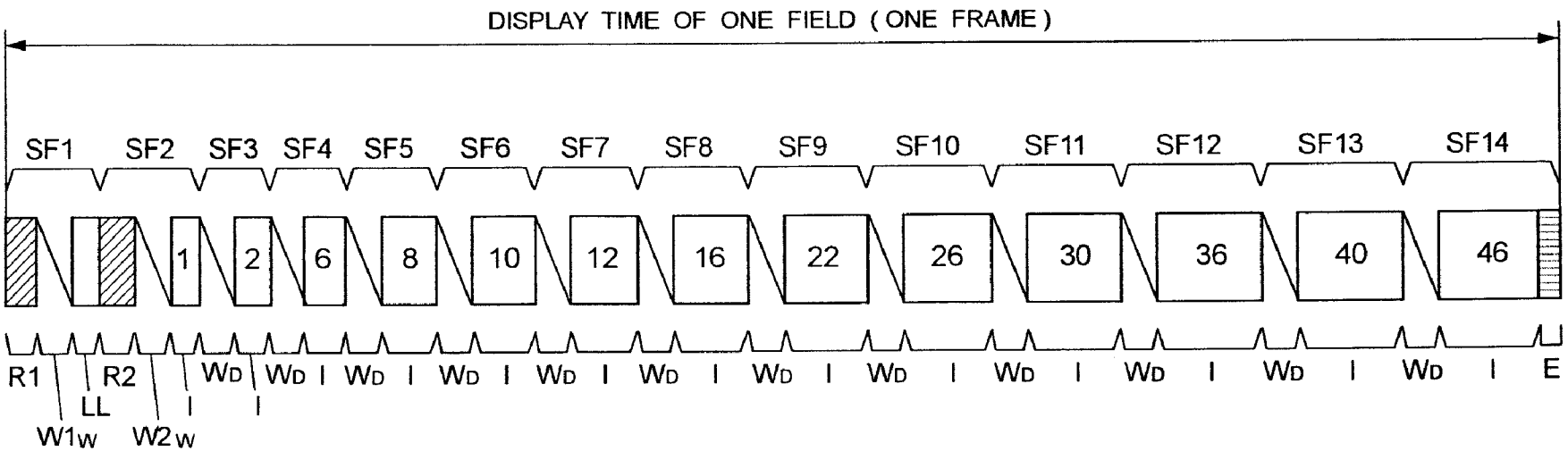
FIG. 7 shows an example of an emission driving sequence employed in the plasma display device shown in FIG. 1.

Moreover, the driving control circuit 56 supplies various control signals for driving the PDP 50 having the previously described structure to a panel driver composed of the X electrode driver 51, the Y electrode driver 53 and the address driver 55 in accordance with an emission driving sequence as shown in FIG. 7. Namely, the driving control circuit 56 supplies various control signals to the panel driver to sequentially execute diving in accordance with each first reset step R1, first selective writing address step W1*w* and microemission step LL in the first subfield SF1 within the display period of one field (one frame) as shown in FIG. 7. The driving control circuit 56 then supplies various control signals to the panel driver to sequentially execute driving in accordance with each second reset step R2, second selective writing address step W2*w* and sustain step I in subfield SF2 following the first subfield SF1. In addition, the driving control circuit 56 supplies various control signals to the panel driver to sequentially execute driving in accordance with each selective erase address step $W_D$ and sustain step I in each subfield SF3 to SF14. Furthermore, the driving control circuit 56 supplies various control signals to the panel driver to sequentially execute driving in accordance with a deletion step E following execution of sustain step I only for the last subfield SF14 within the display period of one field.

Figure 8:
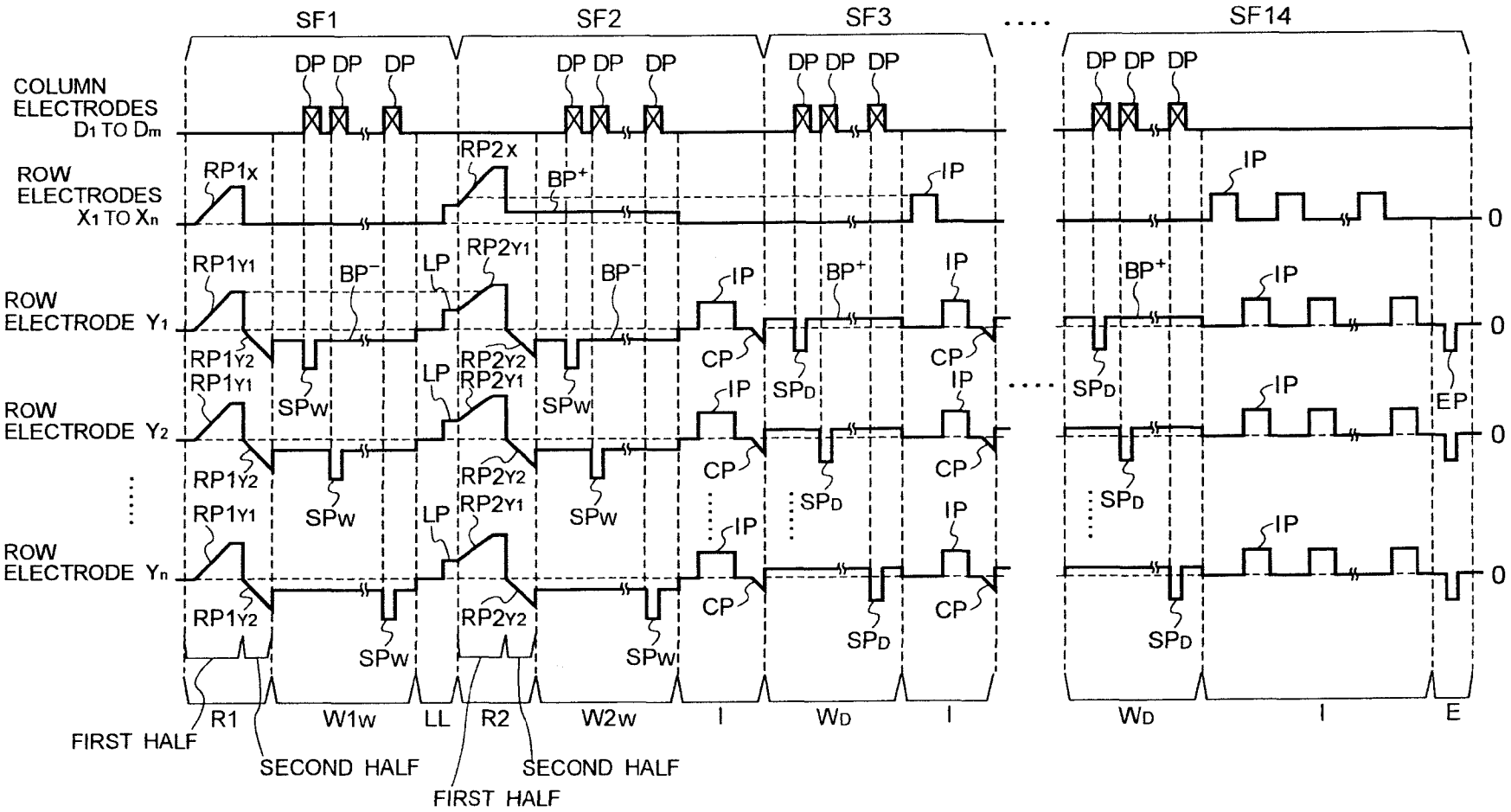
FIG. 8 shows each drive pulse applied to the PDP 50 in accordance with the emission driving sequence shown in FIG. 7.

The panel driver, namely The X electrode driver 51, the Y electrode driver 53 and the address driver 55, generates various drive pulses as shown in FIG. 8 corresponding to the various control signals supplied from the driving control circuit 56, and supplies them to the column electrodes D and row electrodes X and Y of the PDP 50.

Furthermore, FIG. 8 shows an excerpt of only the operations of subfields SF1 to SF3 and the last subfield SF14 among subfields SF1 to SF14 shown in FIG. 7.

First, in the first half of the first reset step R1 of subfield SF1, the Y electrode driver 53 applies a positive polarity reset pulse $RP1_{Y1}$, in which the change in potential at the front edge over time has a gradual waveform as compared with a sustain pulse to be described later, to all row electrodes $Y_1$ to $Y_n$. Furthermore, the peak potential of reset pulse $RP1_{Y1}$ is higher than the peak potential of the sustain pulse and lower than the peak potential of a reset pulse $RP2_{Y1}$ to be described later. In addition, during this time, the address driver 55 sets column electrodes $D_1$ to $D_m$ to the state of a ground potential (0 volts). Moreover, during this time, the X electrode driver 51 respectively applies a reset pulse $RP1_X$, which has the same polarity as the reset pulse $RP1_{Y1}$ and a peak potential capable of preventing surface discharge between row electrodes X and Y accompanying application of the reset pulse $RP_{1Y1}$, to all row electrodes $X_1$ to $X_n$. Furthermore, during this time, the X electrode driver 51 may set all row electrodes $X_1$ to $X_n$ to a ground potential (0 volts) instead of applying reset pulse $RP1_x$ if surface discharge does not occur between row electrodes X and Y. Here, during the first half of the first reset step R1, a weak first reset discharge is respectively generated between row electrodes Y and column electrodes D in all discharge cells PC corresponding to the application of reset pulse $RP1_{Y1}$ as described above. Namely, during the first half of first reset step R1, by applying a voltage between row electrodes Y and column electrodes D with the row electrodes Y serving as the anode and the column electrodes D serving as the cathode, a discharge in which current flows from the row electrodes Y to the column electrodes D (to be referred to as a column cathode discharge) is generated in the form of the first reset discharge as described above. A wall charge having negative polarity is formed near the row electrodes Y and a wall charge having positive polarity is formed near column electrodes D in all discharge cells PC corresponding to this first reset discharge.

Next, in the second half of first reset step R1 of subfield SF1, the Y electrode driver 53 generates a reset pulse $RP1_{Y2}$, having a negative polarity in which the potential at the front edge changes gradually over time, and applies that reset pulse $RP1_{Y2}$ to all row electrodes $Y_1$ to $Y_n$. Furthermore, the negative peak potential of reset pulse $RP1_{Y2}$ is set to a potential that is higher than the peak potential of a writing scanning pulse SPw having negative polarity to be described later, or in other words, is set to a potential near 0 volts. Namely, if the peak potential of reset pulse $RP1_{Y2}$ is lower than the peak potential of writing scanning pulse SPw, a strong discharge is generated between row electrodes Y and column electrodes D, and the wall charge formed in the vicinity of column electrodes D diminishes considerably, thereby causing the address discharge in first selective writing address step W1*w* to become unstable. During this time, the X electrode driver 51 sets all row electrodes $X_1$ to $X_n$ to a ground potential (0 volts). Furthermore, the peak potential of reset pulse $RP1_{Y2}$ is the minimum potential that allows the second reset discharge described above to be reliably generated between row electrodes X and Y in consideration of the wall charges respectively formed in the vicinities of row electrodes X and Y corresponding to the first reset discharge. Here, in the second half of first reset step R1, the second reset discharge is generated between row electrodes X and Y in all discharge cells PC corresponding to application of reset pulse $RP1_{Y2}$ as previously described. Due to this second reset discharge, the wall charge formed in the vicinity of each row electrode X and Y in each discharge cell PC is deleted, and all discharge cells PC are initialized to an off mode. Moreover, a weak discharge is also generated between row electrodes Y and column electrodes D in all discharge cells PC corresponding to application of the reset pulse $RP1_{Y2}$. As a result of this weak discharge, a portion of the positive polarity wall charge formed in the vicinity of column electrodes D is deleted, and adjusted to an amount capable of properly generating the selective writing address discharge in the first selective writing address step W1*w* to be described later.

Next, in the first selective writing address step W1*w* of subfield SF1, the Y electrode driver 53 sequentially and alternatively applies a writing scanning pulse SPw having a peak potential of negative polarity to each row electrode $Y_1$ to $Y_n$ while simultaneously applying, as shown in FIG. 8, a base pulse BP− having a predetermined base potential of negative polarity to the row electrodes $Y_1$ to $Y_n$. During this time, the address driver 55 first converts the pixel driving data bit corresponding to subfield SF1 to a pixel data pulse DP having a pulse voltage corresponding to the logic level thereof. For example, in the case a pixel driving data bit is supplied having a logic level of 1 for setting a discharge cell PC to an on mode, the address driver 55 converts this to a pixel data pulse DP having a peak potential of positive polarity. On the other hand, in the case of a pixel driving data bit having a logic level of 0 for setting a discharge cell PC to an off mode, the address driver 55 converts this to a pixel data pulse DP having a low voltage (0 volts). The address driver 55 then applies this pixel data pulse DP to the column electrodes $D_1$ to $D_m$ in synchronization with the timing at which each writing scanning pulse SPw is applied one display line (m pulses) at a time. At this time, simultaneous to the writing scanning pulse SPw, a selective writing address discharge is generated between column electrodes D and row electrodes Y in discharge cell PC to which pixel data pulse DP has been applied at a high voltage to set to the on mode. Furthermore, during this time, although a voltage corresponding to writing scanning pulse SPw is also applied between row electrodes X and Y, at this stage, since all discharge cells PC are in the off mode, or in other words, are in a state in which wall charge has been deleted, a discharge does not occur between row electrodes X and Y by application of this writing scanning pulse SPw alone. Thus, in first selective writing address step W1*w* of subfield SF1, a selective writing address discharge is only generated between column electrodes D and row electrodes Y in discharge cells PC corresponding to the application of writing scanning pulse SPw and high-voltage pixel data pulse DP. As a result, although a wall charge is not present in the vicinity of row electrodes X in discharge cells PC, the PC discharge cells are set to the state of the on mode in which a wall charge of positive polarity in the vicinity of row electrodes Y and a wall charge of negative polarity in the vicinity of column electrodes D are respectively formed. On the other hand, simultaneous to the writing scanning pulse SPw, a selective writing address discharge as described above is not generated between column electrodes D and row electrodes Y in discharge cell PC to which pixel data pulse DP at a low voltage (0 volts) has been applied to set to the off mode. Accordingly, this discharge cell PC maintains the state of the off mode initialized in first reset step R1, or in other words, the state in which discharge does not occur between row electrodes Y and column electrodes D or between row electrodes X and Y.

Next, in microemission step LL of subfield SF1, the Y electrode driver 53 simultaneously applies a microemission pulse LP having a predetermined peak potential of positive polarity as shown in FIG. 8 to the row electrodes $Y_1$ to $Y_n$. Moreover, during this time, the X electrode driver 51 simultaneously applies an XY discharge preventive pulse PV having the same polarity and same waveform as this microemission pulse LP to the row electrodes $X_1$ to $X_n$ simultaneous to this microemission pulse LP. The respective peak potentials of microemission pulse LP and XY discharge preventive pulse PV are lower than the peak potential of a sustain pulse IP alternatively applied to the row electrodes X and Y in sustain step I to be described later. Namely, the voltage applied between row electrodes Y (row electrodes X) and column electrodes D by microemission pulse LP (XY discharge preventive pulse PV) is lower than the voltage applied between row electrodes X and Y by sustain pulse IP. A discharge is only generated between column electrodes D and row electrodes Y in discharge cells PC set to the on mode corresponding to the application of microemission pulse LP and XY discharge preventive pulse PV (to be referred to as microemission discharge).

Namely, in microemission step LL, as a result of applying microemission pulse LP to the row electrodes Y, a microemission discharge is generated between row electrodes Y and column electrodes D in discharge cells PC set to the on mode. Moreover, during this time, by applying XY discharge preventive pulse PV having the same polarity and same waveform as microemission pulse LP to the row electrodes X, the voltage between row electrodes X and Y is made to be lower than a discharge starting voltage, thereby preventing discharge between row electrodes Y and X. At this time, by making the respective peak potentials of microemission pulse LP and XY discharge preventive pulse PV mutually equal, the voltage applied between row electrodes Y and X may be set to 0 volts. However, although a voltage higher than the discharge starting voltage is applied between row electrodes X and column electrodes D if XY discharge preventive pulse PV is applied to the row electrodes X, as previously described, since a wall charge is not present in the vicinity of row electrodes X in discharge cells PC set to the on mode, there is no generation of a discharge between row electrodes X and column electrodes D.

In addition, as shown in FIG. 8, the rate of change over time during the rise interval (pulse front edge) of the potential of the above-mentioned microemission pulse LP is greater than the rate of change during the rise interval of the reset pulses ($RP1_{Y1}$, $RP2_{Y1}$). In other words, since the change in potential at the front edge of microemission pulse LP is more steep than the change in potential at the front edge of the reset pulse applied during first reset step R1 or second reset step R2, a discharge stronger than the first reset discharge is generated as the microemission discharge.

Here, this microemission discharge is a row-side cathode discharge as previously described and is generated by microemission pulse LP having a lower pulse voltage than sustain pulse IP. Accordingly, the emission luminance accompanying the microemission discharge is lower than the emission luminance accompanying the discharge of the sustain discharge (to be described later) generated between row electrodes X and Y corresponding to sustain pulse IP.

As has been described above, a discharge is generated for the microemission discharge in microemission step LL accompanying a minute emission luminance that is lower than emission luminance accompanying the first reset discharge, but has a lower luminance level accompanying that discharge than the sustain discharge and is of a degree that allows it be used for display. In the first selective writing address step W1*w* executed immediately before microemission step LL, a selective writing address discharge is generated between the column electrodes D and the row electrodes Y within the discharge cell PC. Accordingly, in the subfield SF1, luminance corresponding to a gradation of luminance one step higher than luminance level 0 is expressed by luminescence accompanying the selective writing address discharge and luminescence accompanying the above-mentioned microemission discharge.

Furthermore, a wall charge having a negative polarity in the vicinity of row electrodes Y and a wall charge having a positive polarity in the vicinity of column electrodes D are respectively formed following the microemission discharge described above.

Next, in the first half of second reset step R2 of subfield SF2, the Y electrode driver 53 applies a positive polarity reset pulse $RP2_{Y1}$, having a waveform in which the change in potential at the front edge over time is more gradual as compared with the subsequent reset pulse, to all row electrodes $Y_1$ to $Y_n$. Furthermore, the peak potential of the reset pulse $RP2_{Y1}$, is higher than the peak potential of the above-mentioned reset pulse $RP1_{Y1}$. In addition, during this time, the address driver 55 sets the column electrodes $D_1$ to $D_m$ to the ground potential (0 volts), and the X electrode driver 51 respectively applies a positive polarity reset pulse $RP2_x$, having a peak potential capable of preventing surface discharge between the row electrodes X and Y accompanying application of the reset pulse $RP2_{Y1}$, to all row electrodes $X_1$ to $X_n$. Furthermore, if a surface discharge does not occur between row electrodes X and Y, the X electrode driver 51 may be made to set all row electrodes $X_1$ to $X_n$ to the ground potential (0 volts) instead of applying the reset pulse $RP2_x$. A first reset discharge weaker than the column-side cathode discharge is generated in microemission step LL between the row electrodes Y and the column electrodes D within the discharge cell PC in which a discharge was not generated in microemission step LL within each discharge cell PC corresponding to the application of reset pulse $RP2_{Y1}$. Namely, in the first half of second reset step R2, a column-side cathode discharge, in which current flows from the row electrodes Y to the column electrodes D, is generated for the first reset discharge by applying a voltage between both electrodes with row electrodes Y serving as the anode and column electrodes D serving as the cathode. On the other hand, in those discharge cells PC in which the microemission discharge has already been generated in the microemission step LL, a discharge does not occur even if the reset pulse $RP2_{Y1}$ is applied. Thus, immediately after completion of the first half of the second reset step R2, a state results in which a negative polarity wall charge is formed in the vicinity of the row electrodes Y and a positive polarity wall charge is formed in the vicinity of column electrodes D within all discharge cells PC.

Next, in the second half of the second reset step R2 of the subfield SF2, the Y electrode driver 53 applies a negative polarity reset pulse $RP2_{Y2}$, in which the change in potential at the front edge over time is gradual, to the row electrodes $Y_1$ to $Y_n$. Moreover, in the second half of second reset step R2, the X electrode driver 51 respectively applies a base pulse BP+ having positive polarity and a predetermined base potential to the row electrodes $X_1$ to $X_n$. A second reset discharge is generated between the row electrodes X and Y in all discharge cells PC corresponding to the application of the negative polarity reset pulse $RP2_{Y2}$ and the positive polarity base pulse BP+. Furthermore, the respective peak potentials of the reset pulse $RP2_{Y2}$ and the base pulse BP+ are the minimum potentials that allow the second reset discharge to be reliably generated between row electrodes X and Y in consideration of the wall charges formed by the first reset discharge in the vicinity of each row electrode X and Y. In addition, the negative peak potential during reset pulse $RP2_{Y2}$ is set to be higher than the peak potential of negative polarity writing scanning pulse SPw, namely to a potential near 0 volts.

Namely, if the peak potential of the reset pulse RP2Y2 is lower than the peak potential of the writing scanning pulse SPw, a strong discharge is generated between the row electrodes Y and the column electrodes D, the wall charge formed in the vicinity of column electrodes D is diminished considerably, and the address discharge of second selective writing step W2*w* becomes unstable. Here, due to the second reset discharge generated in the second half of second reset step R2, the wall charge formed in the vicinity of each row electrode X and Y in each discharge cell PC is deleted, and all discharge cells PC are initialized to the off mode. Moreover, a weak discharge is also generated between the row electrodes Y and the column electrodes D in all discharge cells PC corresponding to the application of reset pulse $RP2_{Y2}$, and as a result of this discharge, and a portion of the positive polarity wall charge formed in the vicinity of the column electrodes D is deleted and adjusted to an amount capable of properly generating the selective writing address discharge in second selective writing address step W2*w*.

Next, as shown in FIG. 8, in the second selective writing address step W2*w* of the subfield SF2, the Y electrode driver 53 sequentially and alternatively applies a writing scanning pulse SPw having a peak potential of negative polarity to each row electrode $Y_1$ to $Y_n$ while simultaneously applying a base pulse BP− having a predetermined base potential of negative polarity to the row electrodes $Y_1$ to $Y_n$. The X electrode driver 51 continues to apply to each of the row electrodes $X_1$ to $X_n$ the base pulse BP+ applied to the row electrodes $X_1$ to $X_n$ during the second half of second reset step R2 during this second selective writing address step W2*w* as well. Furthermore, potentials of the base pulse BP− and the base pulse BP+ are set so that the voltage between row electrodes X and Y during the time writing scanning pulse SPw is not applied is lower than the discharge starting voltage of discharge cell PC. Moreover, in second selective writing address step W2*w*, the address driver 55 first converts the pixel driving data bit corresponding to subfield SF2 to a pixel data pulse DP having a pulse voltage corresponding to the logic level thereof. For example, in the case a pixel driving data bit is supplied having a logic level of 1 for setting a discharge cell PC to the on mode, the address driver 55 converts this to a pixel data pulse DP having a peak potential of positive polarity. On the other hand, in the case of a pixel driving data bit having a logic level of 0 for setting a discharge cell PC to the off mode, the address driver 55 converts this to a pixel data pulse DP having a low voltage (0 volts). The address driver 55 then applies this pixel data pulse DP to the column electrodes $D_1$ to $D_m$ in synchronization with the timing at which each writing scanning pulse SPw is applied one display line (m pulses) at a time. Simultaneous to the writing scanning pulse SPw, a selective writing address discharge is generated between column electrodes D and row electrodes Y in discharge cell PC to which pixel data pulse DP has been applied at a high voltage to set to the on mode. Moreover, immediately after this selective writing address discharge, a weak discharge is also generated between row electrodes X and Y within this discharge cell PC. In other words, after writing scanning pulse SPw has been applied, although a voltage corresponding to the base pulse BP− and the base pulse BP+ is applied between the row electrodes X and Y, since this voltage is set to a voltage lower than the discharge starting voltage of each discharge cell PC, discharge does not occur within discharge cell PC as a result of applying this voltage alone. However, when the selective writing address discharge is generated, a discharge is generated between the row electrodes X and Y only by the application of the voltage based on the base pulse BP− and the base pulse BP+ as a result of being induced by this selective writing address discharge. Such discharge is not generated in the first selective writing address step W1*w* in which the base pulse BP+ is not applied to the row electrodes X. As a result of this discharge and the selective writing address discharge previously described, this discharge cell PC is set to a state in which a positive polarity wall charge in the vicinity of the row electrodes Y thereof, a negative polarity wall charge in the vicinity of the row electrodes X, and a negative polarity wall charge in the vicinity of the column electrodes D are respectively formed, namely the on mode. On the other hand, a selective writing address discharge as described above is not generated between the column electrodes D and the row electrodes Y in the discharge cell PC to which a pixel data pulse DP having a low voltage (0 volts) has been applied to set to the off mode simultaneous to the above-mentioned writing scanning pulse SPw, and for this reason, a discharge does not occur between the row electrodes X and Y either. Accordingly, this discharge cell PC is maintained in the immediately previous state, namely the state of the off mode initialized in the second reset step R2.

Next, in the sustain step I of the subfield SF2, the Y electrode driver 53 generates a single sustain pulse IP having a peak potential of positive polarity, and respectively applies that pulse to the row electrodes $Y_1$ to $Y_n$. During this time, the X electrode driver 51 sets the row electrodes $X_1$ to $X_n$ to a ground potential (0 volts), while the address driver 55 sets the column electrodes $D_1$ to $D_m$ to a ground potential (0 volts). A sustain discharge is then generated between the row electrodes X and Y within discharge cells PC set to the on mode in the manner described above corresponding to the application of sustain pulse IP. As a result of light radiated from the phosphor layer 17 accompanying this sustain discharge being radiated to the outside through the front transparent substrate 10, a single display emission is executed corresponding to the luminance weighting of this subfield SF1. In addition, a discharge is also generated between the row electrodes Y and the column electrodes D in the discharge cells PC set to the on mode corresponding to the application of this sustain pulse IP. Due to this discharge and the sustain discharge mentioned above, a negative polarity wall charge in the vicinity of the row electrodes Y, and positive polarity wall discharges in the vicinities of the row electrodes X and the column electrodes D are respectively formed in the discharge cells PC. Following application of this sustain pulse IP, as shown in FIG. 8, the Y electrode driver 53 applies a wall charge adjustment pulse CP, having a peak potential of negative polarity in which the change in potential at the front edge over time is gradual, to the row electrodes $Y_1$ to $Y_n$. A weak deletion discharge is then generated within the discharge cells PC in which the above-mentioned sustain discharge has been generated corresponding to the application of this wall charge adjustment pulse CP, and a portion of the wall charge formed therein is deleted. As a result, the amount of the wall charge in discharge cells PC is adjusted to an amount that allows the proper generation of a selective erase address discharge in subsequent selective erase address step $W_D$.

Next, in each selective erase address step $W_D$ of the subfields SF3 to SF14, the Y electrode driver 53 sequentially and alternatively applies a deletion scanning pulse SPD having a peak potential of negative polarity to each row electrode $Y_1$ to $Y_n$ as shown in FIG. 8 while applying the base pulse BP+ having a predetermined base potential of positive polarity to each row electrode $Y_1$ to $Y_n$. Furthermore, the peak potential of the base pulse BP+ is set to a potential capable of preventing erroneous discharge between the row electrodes X and Y during the entire time this selective erase address step $W_D$ is executed. In addition, the X electrode driver 51 sets each row electrode $X_1$ to $X_n$ to a ground potential (0 volts) during entire time selective erase address step $W_D$ is executed. In addition, during this selective erase address step $W_D$, the address driver 55 first converts the pixel driving data bit corresponding to that subfield SF to a pixel data pulse DP having a pulse voltage corresponding to the logic level thereof. For example, in the case a pixel driving data bit is supplied having a logic level of 1 for changing a discharge cell PC from the on mode to the off mode, the address driver 55 converts this to a pixel data pulse DP having a peak potential of positive polarity. On the other hand, in the case of a pixel driving data bit having a logic level of 0 for maintaining a discharge cell PC in its current state, the address driver 55 converts this to a pixel data pulse DP having a low voltage (0 volts). The address driver 55 then applies this pixel data pulse DP to the column electrodes $D_1$ to $D_m$ in synchronization with the timing at which each deletion scanning pulse SPD is applied one display line (m pulses) at a time. At this time, simultaneous to the deletion scanning pulse SPD, a selective erase address discharge is generated between the column electrodes D and the row electrodes Y in discharge cell PC to which pixel data pulse DP has been applied at a high voltage. As a result of this selective erase address discharge, this discharge cell PC is set to a state in which positive polarity wall charges in the vicinity of each row electrode Y and row electrode X and a negative polarity wall charge in the vicinity of column electrodes D are respectively formed, namely to the off mode. On the other hand, a selective erase address discharge as described above is not generated between the column electrodes D and the row electrodes Y in discharge cell PC to which pixel data pulse DP having a low voltage (0 volts) has been applied simultaneous to the deletion scanning pulse SPD. Accordingly, this discharge cell PC is maintained in the state immediately prior thereto (on mode, off mode).

Next, in sustain step I of each subfield SF3 to SF14, as shown in FIG. 8, the X electrode driver 51 and the Y electrode driver 53 respectively apply the sustain pulse IP having a peak potential of positive polarity to the row electrodes $X_1$ to $X_n$ and $Y_1$ to $Y_n$ by repeating for a number of times (even number of times) corresponding to the luminance weighting of that subfield while alternating between the row electrodes X and Y. Each type this sustain pulse IP is applied, a sustain discharge is generated between the row electrodes X and Y in the discharge cell PC set to the on mode. As a result of light radiated from the phosphor layer 17 accompanying this sustain discharge radiating to the outside through the front transparent substrate 10, a display emission occurs for the number of times corresponding to the luminance weighting of that subfield SF. At this time, a negative polarity wall charge in the vicinity of row electrodes Y and a positive polarity wall charge in the vicinity of each row electrode X and column electrode D is formed in discharge cell PC in which a sustain discharge has been generated corresponding to sustain pulse IP finally applied in the sustain steps I of each subfield SF2 to SF14. Following application of this final sustain pulse IP, as shown in FIG. 8, the Y electrode driver 53 applies a wall charge adjustment pulse CP, having a peak potential of negative polarity in which the change in potential at the front edge over time is gradual, to the row electrodes $Y_1$ to $Y_n$. A weak deletion discharge is then generated within discharge cells PC in which the above-mentioned sustain discharge has been generated corresponding to the application of this wall charge adjustment pulse CP, and a portion of the wall charge formed therein is deleted. As a result, the amount of wall charge in the discharge cells PC is adjusted to an amount that allows the proper generation of a selective erase address discharge in subsequent selective erase address step $W_D$.

Following completion of the sustain step I of the last subfield SF14, the Y electrode driver 53 applies an elimination pulse EP having a peak potential of negative polarity to all row electrodes $Y_1$ to $Y_n$. An elimination discharge is then generated in only those discharge cells PC in the on mode corresponding to application of this elimination pulse EP. The discharge cells PC in the on mode are changed to the state of the off mode as a result of this elimination discharge.

As has been described above, driving is executed on the basis of 16 types of pixel driving data GD as shown in FIG. 6.

First, in a second gradation expressing luminance one level higher than a first gradation expressing a black display (luminance level 0), the selective writing address discharge for setting a discharge cell PC to the on mode is generated only in the subfield SF1 of the subfields SF1 to SF14 as shown in FIG. 6, and the discharge cell PC set to the on mode is made to undergo the microemission discharge (indicated with squares). At this time, the luminance level during luminescence accompanying this selective writing address discharge and the microemission discharge is lower than the luminance level during luminescence accompanying a single sustain discharge. Accordingly, in the case the luminance level visualized by the sustain discharge is taken to be "1", then a luminance level corresponding to a luminance level "α" lower than luminance level "1" is expressed in the second gradation.

Next, in a third gradation expressing luminance one level higher than the second gradation, a selective writing address discharge for setting a discharge cell PC to the on mode is generated in the subfield SF2 only of the subfields SF1 to SF14 (indicated with double circles). A selective erase address discharge for changing the discharge cell PC to the off mode is generated in the following subfield SF3 (indicated with black circles). Accordingly, luminance accompanying a single sustain discharge occurs only in the sustain step I of the subfield SF2 among the subfields SF1 to SF14 in the third gradation, and luminance corresponding to luminance level "1" is expressed.

Next, in a fourth gradation expressing luminance one level higher than the third gradation, a selective writing address discharge for setting a discharge cell PC to the on mode is first generated in the subfield SF1, and the discharge cell PC set to the on mode is made to under the microemission discharge (indicated with squares). Moreover, in this fourth gradation, a selective writing address discharge for setting the discharge cell PC to the on mode is generated only in the subfield SF2 of the subfields SF1 to SF14 (indicated with double circles), and a selective erase address discharge for changing the discharge cell PC to the off mode is generated in the following subfield SF3 (indicated with black circles). Accordingly, in the fourth gradation, since luminescence of a luminance level "α" occurs in subfield SF1, and a single sustain discharge is executed accompanying luminescence of a luminance level "1" in SF2, luminance is expressed corresponding to a luminance level of "α"+"1".

In addition, in each of the fifth to sixteenth gradations, a selective writing address discharge for setting a discharge cell PC to the on mode is generated in subfield SF1, and the discharge cell PC set to the on mode is made to undergo the microemission discharge (indicated with squares). A selective erase address discharge for changing the discharge cell PC to the off mode is then generated only in the single subfield corresponding to that gradation (indicated with black circles). Accordingly, in each of the fifth to sixteenth gradations, after the microemission discharge is generated in the subfield SF1 and a single sustain discharge is generated in SF2, a number of sustain discharges assigned to a particular subfield is generated in each of a number of continuous subfields corresponding to that gradation (indicated with white circles). As a result, in each of the fifth to sixteenth gradations, luminance is visualized corresponding to a luminance level "α"+"total number of sustain discharges generated during the display period of one field (or one frame)".

Namely, according to the driving as shown in FIG. 6, a luminance range consisting of luminance levels from "0" to "255+α" can be expressed with 16 gradations as shown in FIG. 6.

According to this driving, since regions in which luminescence patterns thereof (on state, off state) are mutually inverted within the display period of a single field are not present in combination on a single screen, false contour that occurs in such states is prevented.

Here, in the case of driving as shown in FIG. 8, a column-side cathode discharge, in which current flows from the row electrodes Y to the column electrodes D, is generated in the form of a first reset discharge by applying a voltage using the column electrodes D as the cathode and the row electrodes Y as the anode between both electrodes in each of the first reset step R1 of the subfield SF1 and the second reset step R2 of the subfield SF2. Accordingly, during the first reset discharge, cations in the discharge gas collide with a secondary electron releasing material in the form of MgO crystals contained in the phosphor layer 17 as shown in FIG. 5 as they move towards column electrodes D causing secondary electrons to be released from these MgO crystals. In plasma display device the PDP 50 shown in FIG. 1 in particular, as a result of MgO crystals being exposed to the discharge space as shown in FIG. 5, the probability of colliding with cations is increased, thereby enabling secondary electrons to be efficiently released into the discharge space. Since the discharge starting voltage of discharge cells PC is lowered due to the priming action caused by these secondary electrons, it is possible to generated a comparatively weak reset discharge. Accordingly, since the emission luminance accompanying this discharge decreases as a result of weakening the reset discharge, display is possible in which contrast when displaying dark images, or so-called dark contrast, is improved.

Moreover, in the case of driving as shown in FIG. 8, a first reset discharge is generated between the row electrodes Y formed on the front transparent substrate 10 and the column electrodes D formed on the rear substrate 14 a shown in FIG. 3. Accordingly, in comparison with the case of generating a reset discharge between the row electrodes X and Y both formed on the front transparent substrate 10, the emitted light released to the outside from front transparent substrate 10 is reduced, thereby further improving dark contrast.

In addition, in the case of driving as shown in FIGS. 6 to 8, after having generated a reset discharge for initializing all discharge cells PC to the state of the off mode in the first subfield SF1, a selective writing address discharge is generated for changing discharge cells PC in the off mode to the on mode. In each subfield SF3 to SF14 following the subfield SF2, driving is executed that employs a selective erase address method in which a selective erase address discharge is generated for changing discharge cells PC in the on mode to the off mode. Accordingly, when a black display (luminance level 0) is carried out by driving in accordance with a first gradation as shown in FIG. 6, the only discharge generated through the display period of a single field is the reset discharge in the first subfield SF1. Thus, compared with the case of employing driving in which a reset discharge is generated that initializes all discharge cells PC in subfield SF1 to the on mode followed by generating a selective erase address discharge that changes the discharge cells PC to the off mode, the number of discharges generated throughout the display period of a single field is reduced, thereby making it possible to improve dark contrast.

In addition, in the case of driving as shown in FIGS. 6 to 8, in subfield SF1 in which the luminance weighting is the smallest, a microemission discharge instead of a sustain discharge is generated as the discharge that contributes to a display image. At this time, since this microemission discharge is a discharge generated between the column electrodes D and the row electrodes Y, in comparison with sustain discharge generated between the row electrodes X and Y, the luminance level during luminescence accompanying that discharge is low. Accordingly, in the case of expressing luminance one level higher than a black display (luminance level 0) by this microemission discharge (second gradation), the difference in luminance with luminance level 0 is smaller in comparison with the case of expressing this by sustain discharge. Thus, the ability to express contrast when expressing images of low luminance is enhanced. In addition, in the second gradation, since a reset discharge is not generated in the second reset step R2 of the subfield SF2 following the subfield SF1, a decrease in dark contrast accompanying this reset discharge is inhibited.

In addition, in the case of driving as shown in FIG. 8, the peak potential of reset pulse $RP1_{Y1}$ applied to the row electrodes Y to generate the first reset discharge in the first reset step R1 of the subfield SF1 is lower than the peak potential of the reset pulse $RP2_{Y1}$ applied to the row electrodes Y to generate the first reset discharge in the second reset step R2 of the subfield SF2. As a result, luminescence when all discharge cells PC are made to undergo reset discharge en bloc in the first reset step R1 of the subfield SF1 is diminished, thereby inhibiting a decrease in dark contrast.

In addition, in the case of driving as shown in FIGS. 6 to 8, in the sustain step I of the subfield SF2 having the next smallest luminance weighting, the ability to express contrast when expressing images of low luminance is enhanced by generating only one sustain discharge. Furthermore, since the sustain pulse IP applied to generate the sustain discharge is applied only once in the sustain step I of the subfield SF2, a negative polarity wall charge in the vicinity of the row electrodes Y and a positive polarity wall charge in the vicinity of the column electrodes D are respectively formed following dissipation of the sustain discharge generated corresponding to this single sustain pulse IP. As a result, in the subsequent selective erase address step $W_D$ of subfield SF3, a discharge using the row electrodes D for the anode side (to be referred to as column-side cathode discharge) can be generated between column electrodes D and row electrodes Y in the form of a selective erase address discharge. On the other hand, in the sustain steps I of each of the subsequent subfields SF3 to SF14, the sustain pulse IP is applied an even number of times. Accordingly, since the negative polarity wall charge in the vicinity of the row electrodes Y and the positive polarity wall charge in the vicinity of the column electrodes D are formed immediately after completion of each sustain step I, column-side cathode discharge becomes possible in selective erase address step $W_D$ executed following each sustain step I. Thus, the column electrodes D only receive the positive polarity pulse, thereby inhibiting increases in the cost of the address driver 55.

In addition, in the PDP 50 shown in FIG. 1, a secondary electron releasing material in the form of CL luminescence MgO crystals are contained not only in the magnesium oxide layer 13 formed on the front transparent substrate 10, but also in the phosphor layer 17 formed on the rear substrate 14 in each discharge cell PC.

Figure 9:
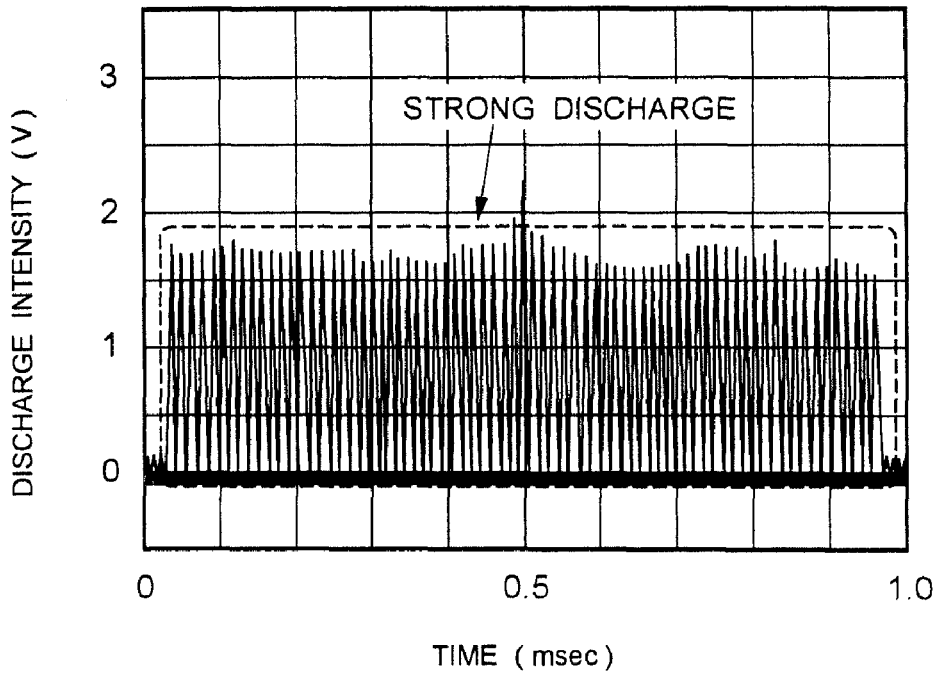
FIG. 9 shows the changes in discharge intensity during column-side cathode discharge generated when a reset pulse RPY1 is applied to a PDP of the prior art containing CL luminescence MgO crystals only in a magnesium oxide layer 13.
Figure 10:
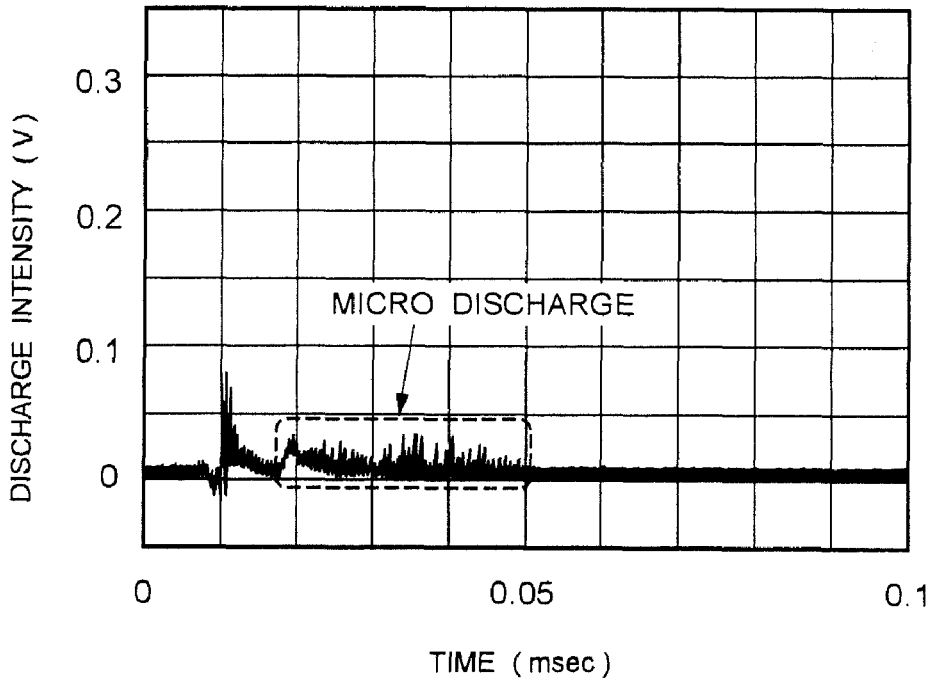
FIG. 10 shows the changes in discharge intensity during column-side cathode discharge generated when the reset pulse $RP_{Y1}$ is applied to the PDP 50 containing CL luminescence MgO crystals in both the magnesium oxide layer 13 and the phosphor layer 17.

The following provides an explanation of the action and effects obtained by employing this type of constitution with reference to FIGS. 9 and 10.

Furthermore, FIG. 9 shows changes in discharge intensity during the column-side cathode discharge generated when reset pulses $RP1_{Y1}$ and $RP2_{Y1}$ are applied as shown in FIG. 8 to a so-called conventional PDP in which CL luminescence MgO crystals are contained only in the magnesium oxide layer 13 among the magnesium oxide layer 13 and the phosphor layer 17 as described above.

On the other hand, FIG. 10 shows changes in discharge intensity during the column-side cathode discharge generated when reset pulses $RP1_{Y1}$ and $RP2_{Y1}$ are applied to the PDP 50 according to the present embodiment in which CL luminescence MgO crystals are contained in both magnesium oxide layer 13 and the phosphor layer 17.

As shown in FIG. 9, according to this conventional PDP, although a comparatively strong column-side cathode discharge persists for 1 ms or more corresponding to application of reset pulses $RP1_{Y1}$ and $RP2_{Y1}$, according to the PDP 50 of the present embodiment, the column-side cathode discharge dissipates within about 0.04 ms as shown in FIG. 10. Namely, the discharge delay time during column-side cathode discharge can be shortened considerably as compared with the conventional PDP.

Thus, as shown in FIG. 8, when a column-side cathode discharge is generated by applying reset pulses RP1Y1 and RP2Y1, in which the change in potential during the rise interval has a gradual waveform, to the row electrodes Y of the PDP 50, that discharge dissipates before the potential of row electrodes Y reaches the peak potential of the pulses. Accordingly, since a column-side cathode discharge dissipates at the stage when the voltage applied between the row electrodes and column electrodes is low, the discharge intensity thereof decreases far more than in the case of FIG. 9 as shown in FIG. 10.

Namely, as a result of applying the reset pulses $RP1_{Y1}$ and $RP2_{Y1}$ as shown in FIG. 8, in which the change in potential during the rise interval has a gradual waveform, to the PDP 50 containing CL luminescence MgO crystals in both of the magnesium oxide layer 13 and the phosphor layer 17, a column-side cathode discharge is generated having weak discharge intensity. Thus, since a column-side cathode discharge having an extremely weak discharge intensity can be made to be generated as a reset discharge in this manner, image contrast, and particularly dark contrast when display dark images, can be enhanced.

Figure 11:
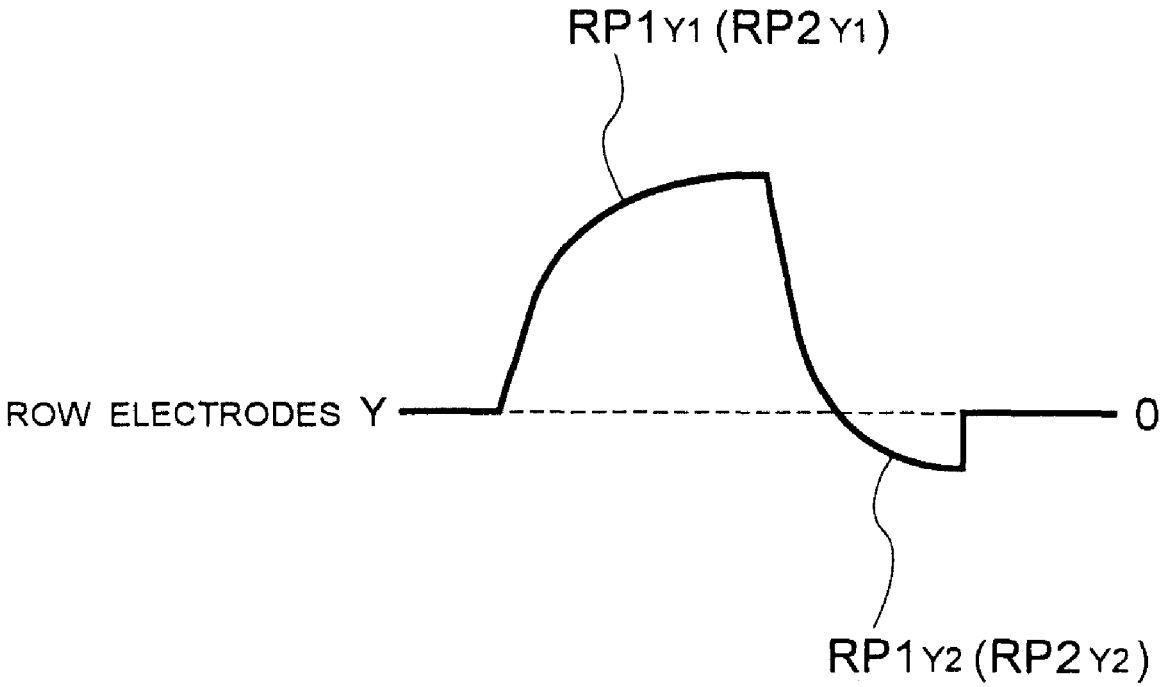
FIG. 11 shows another waveform of a reset pulse $RP1_{Y1}$ ($RP2_{Y2}$)

Furthermore, the waveform during the rise interval of reset pulses $RP1_{Y1}$ and $RP2_{Y1}$ is not limited to that having a constant slope as shown in FIG. 8, but rather, for example, the slope may change gradually over time as shown in FIG. 11.

Figure 12:
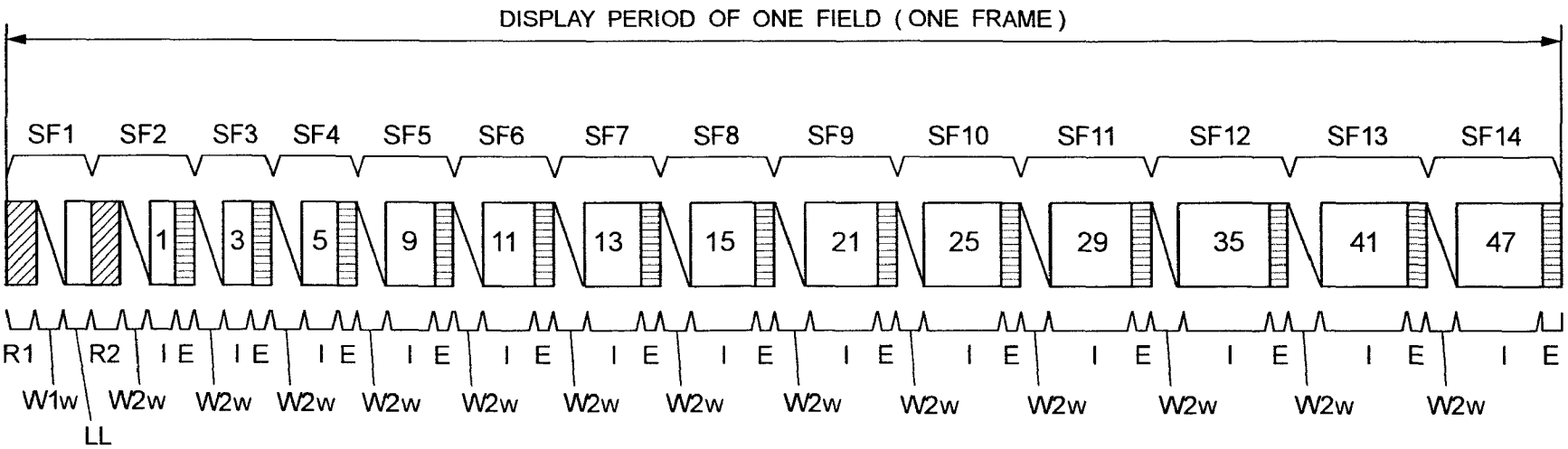
FIG. 12 shows another example of an emission driving sequence employed in the plasma display device shown in FIG. 1.

In addition, although the PDP 50 is driven in accordance with an emission driving sequence employing a selective erase address method as shown in FIG. 7 in the above-mentioned embodiment, it may also be driven in accordance with an emission driving sequence employing a selective writing address method as shown in FIG. 12.

Namely, the driving control circuit 56 supplies various control signals to a panel driver for sequentially executing driving in accordance with each first reset step R1, first selective writing address step W1*w* and microemission step LL in first subfield SF1 during the display period of one field (one frame) as shown in FIG. 12. In addition, the driving control circuit 56 supplies various control signals to a panel driver for sequentially executing driving in accordance with each second selective writing address step W2*w*, sustain step I and elimination step E in each subfield SF2 to SF14. In addition, the driving control circuit 56 supplies various control signals to a panel driver to sequentially executing driving in accordance with second reset step R2 prior to second selective writing address step W2*w* in subfield SF2.

Figure 13:
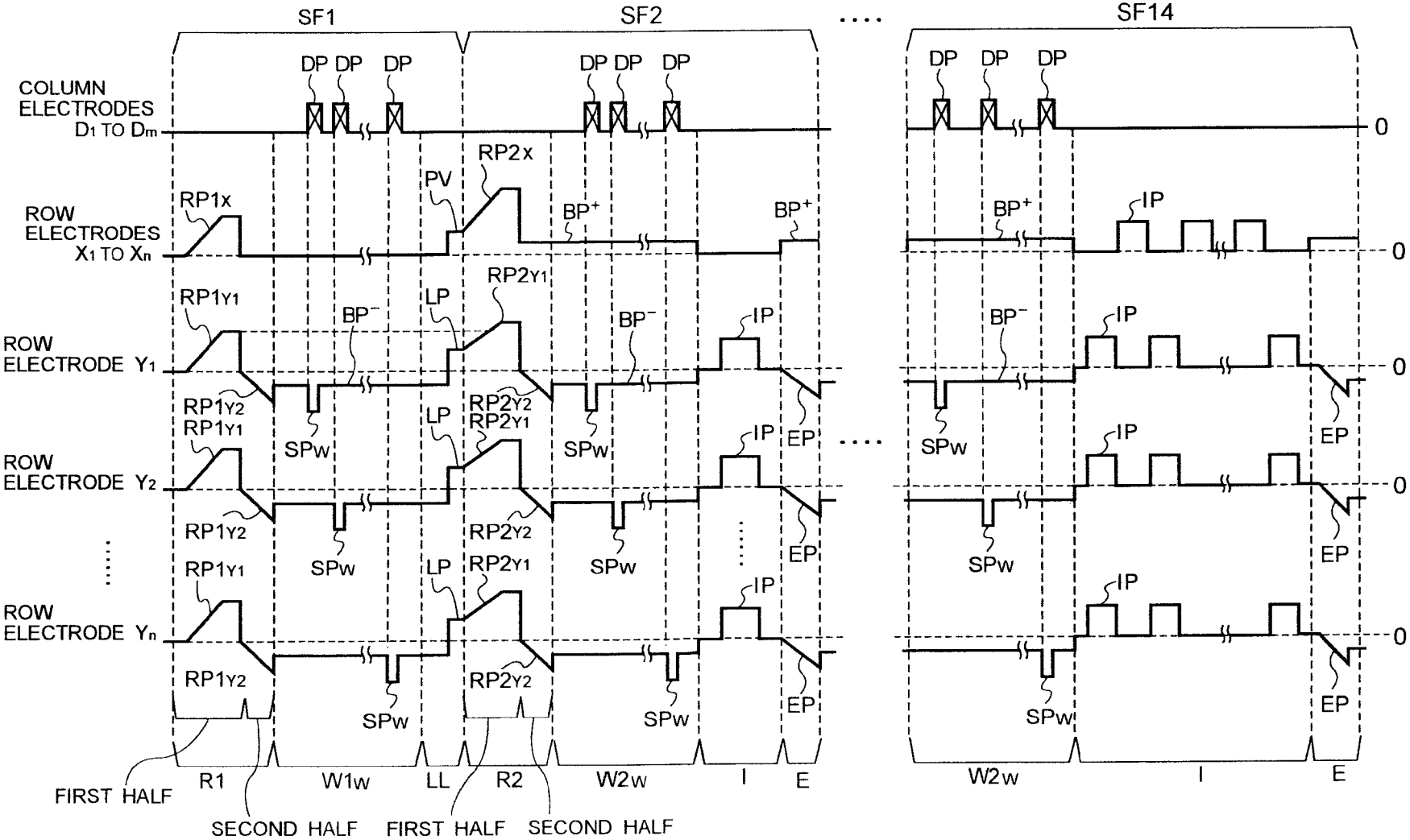
FIG. 13 shows each drive pulse applied to the PDP 50 in accordance with the emission driving sequence shown in FIG. 12.

The panel driver, namely the X electrode driver 51, the Y electrode driver 53 and the address driver 55, generate various drive pulses as shown in FIG. 13 corresponding to the various control signals supplied from the driving control circuit 56, and supplies them to the column electrodes D and the row electrodes X and Y of the PDP 50.

Furthermore, FIG. 13 shows only the operations in the first subfield SF1, the subsequent subfield SF2 and the last subfield SF14 among subfields SF1 to SF14 shown in FIG. 12. In addition, in FIG. 13, since each of the operations of first reset step R1, first selective writing address step W1*w* and microemission step LL in subfield SF1, and the operation in second reset step R2 in subfield SF2, are the same as those shown in FIG. 8, their explanations have been omitted.

First, in second selective writing address step W2*w* of each subfield SF2 to SF14, the Y electrode driver 53 sequentially and alternatively applies a writing scanning pulse SPw having a peak potential of negative polarity to each row electrode $Y_1$ to $Y_n$ while simultaneously applying a base pulse BP− having a predetermined base potential of negative polarity to the row electrodes $Y_1$ to $Y_n$. During this time, the X electrode driver 51 respectively applies a base pulse BP+ having a predetermined base potential of positive polarity to the row electrodes $X_1$ to $X_n$. Furthermore, each potential of the base pulse BP− and the base pulse BP+ is set so that the voltage between row electrodes X and Y during the time writing scanning pulse SPw is not applied is lower than the discharge starting voltage of discharge cell PC. Moreover, in second selective writing address step W2*w*, the address driver 55 first converts the pixel driving data bit corresponding to each subfield (SF2 to SF14) to a pixel data pulse DP having a pulse voltage corresponding to the logic level thereof. For example, in the case a pixel driving data bit is supplied having a logic level of 1 for setting a discharge cell PC to the on mode, the address driver 55 converts this to a pixel data pulse DP having a peak potential of positive polarity. On the other hand, in the case of a pixel driving data bit having a logic level of 0 for setting a discharge cell PC to the off mode, the address driver 55 converts this to a pixel data pulse DP having a low voltage (0 volts). The address driver 55 then applies this pixel data pulse DP to the column electrodes $D_1$ to $D_m$ in synchronization with the timing at which each writing scanning pulse SPw is applied one display line (m pulses) at a time. At this time, simultaneous to the writing scanning pulse SPw, a selective writing address discharge is generated between the column electrodes D and the row electrodes Y in discharge cell PC to which pixel data pulse DP has been applied at a high voltage to set to the on mode. Moreover, immediately after this selective writing address discharge, a weak discharge is also generated between the row electrodes X and Y within this discharge cell PC. In other words, after the writing scanning pulse SPw has been applied, although a voltage corresponding to base pulse BP− and base pulse BP+ is applied between row electrodes X and Y, since this voltage is set to a voltage lower than the discharge starting voltage of each discharge cell PC, discharge does not occur within discharge cell PC as a result of applying this voltage alone. However, when the selective writing address discharge is generated, a discharge is generated between the row electrodes X and Y only by the application of the voltage based on the base pulse BP− and the base pulse BP+ as a result of being induced by this selective writing address discharge. Such discharge is not generated in the first selective writing address step W1*w* in which the base pulse BP+ is not applied to the row electrodes X. As a result of this discharge and the selective writing address discharge previously described, this discharge cell PC is set to a state in which a positive polarity wall charge in the vicinity of row electrodes Y thereof, a negative polarity wall charge in the vicinity of row electrodes X, and a negative polarity wall charge in the vicinity of the column electrodes D are respectively formed, namely to the on mode. On the other hand, a selective writing address discharge as described above is not generated between the column electrodes D and the row electrodes Y in discharge cell PC to which a pixel data pulse DP having a low voltage (0 volts) has been applied to set to the off mode simultaneous to the above-mentioned writing scanning pulse SPw, and for this reason, a discharge does not occur between the row electrodes X and Y either. Accordingly, this discharge cell PC is maintained in the immediately previous state (off mode or on mode).

Next, in sustain step I of subfield SF2, the Y electrode driver 53 generates a single sustain pulse IP having a peak potential of positive polarity, and simultaneously applies that pulse to each row electrode $Y_1$ to $Y_n$. During this time, the X electrode driver 51 sets the row electrodes $X_1$ to $X_n$ to a ground potential (0 volts), while the address driver 55 sets the column electrodes $D_1$ to $D_m$ to a ground potential (0 volts). A sustain discharge is then generated between the row electrodes X and Y in the discharge cells PC set to the on mode corresponding to the application of sustain pulse IP. As a result of light radiated from the phosphor layer 17 accompanying this sustain discharge being radiated to the outside through the front transparent substrate 10, a single display emission is executed corresponding to the luminance weighting of this subfield SF2. In addition, a discharge is also generated between the row electrodes Y and the column electrodes D in the discharge cells PC set to the on mode corresponding to the application of this sustain pulse IP. Due to this discharge and the sustain discharge mentioned above, a negative polarity wall charge in the vicinity of row electrodes Y, and positive polarity wall discharges in the vicinities of row electrodes X and column electrodes D are respectively formed in discharge cells PC.

Next, in an elimination step E of each subfield SF2 to SF14, the Y electrode driver 53 applies a negative polarity elimination pulse EP to the row electrodes $Y_1$ to $Y_n$ having the same waveform as reset pulse $RP2_{Y2}$ applied in the second half of the first reset step R1 and the second reset step R2. During this time, the X electrode driver 51 applies the base pulse BP+ having the predetermined base potential of positive polarity to all row electrodes $X_1$ to $X_n$ in the same manner as the second half of the second reset step R2. A weak elimination discharge is then generated in discharge cells PC in which a sustain discharge has been generated as previously described corresponding to this elimination pulse EP and the base pulse BP+. As a result of this elimination discharge, a portion of the wall charge formed in the discharge cell PC is deleted, and this discharge cell PC is changed to the off mode. Moreover, a weak discharge is also generated between column electrodes D and row electrodes Y in discharge cell PC corresponding to the application of this elimination pulse EP. As a result of this discharge, wall charge of positive polarity formed in the vicinity of the column electrodes D is adjusted to an amount that allows the proper generation of a selective writing address discharge in the subsequent second selective writing address step W2$w$. Furthermore, in each subfield SF3 to SF14, the second selective writing address step W2$w$ is executed instead of the selective erase address step $W_D$.

Next, in sustain step I of each subfield SF3 to SF14, as shown in FIG. 13, the X electrode driver 51 and the Y electrode driver 53 apply sustain pulse IP having a peak potential of positive polarity to the row electrodes $X_1$ to $X_n$ and $Y_1$ to $Y_n$ by repeating for a number of times corresponding to the luminance weighting of that subfield while alternating between the row electrodes X and Y. Each time this sustain pulse IP is applied, a sustain discharge is generated between the row electrodes X and Y in the discharge cell PC set to the on mode. As a result of light radiated from the phosphor layer 17 accompanying this sustain discharge radiating to the outside through the front transparent substrate 10, a display emission occurs for the number of times corresponding to the luminance weighting of that subfield SF. Furthermore, the total number of sustain pulses IP applied in each sustain step I is odd. Namely, in each sustain step I, the first sustain pulse IP and the last sustain pulse IP are both applied to the row electrodes Y. Accordingly, immediately after completion of each sustain step I, a negative polarity wall charge in the vicinity of the row electrodes Y, and positive polarity wall charges in the vicinity of each of the row electrode X and the column electrode D, are respectively formed in discharge cell PC in which a sustain discharge has been generated. As a result, the status of wall charge formation in each discharge cell PC is the same as that immediately after the completion of the first reset discharge in the first reset step R1 or the second reset step R2. Thus, in an elimination step E executed immediately thereafter, a elimination pulse EP having the same waveform as the reset pulse $RP1_{Y2}$ or $RP2_{Y2}$ applied in the second half of first reset step R1 or second reset step R2 is applied to the row electrodes Y, thereby enabling all discharge cells PC to be changed to the state of the off mode.

Here, in a second gradation expressing luminance one level higher than a first gradation expressing a black display (luminance level 0), a selective writing address discharge is generated only in the subfield SF1 of the subfields SF1 to SF14 based on the driving shown in FIGS. 12 and 13. As a result, a microemission discharge is generated in the form of a discharge involved with a display image in only the subfield SF1 among the subfields SF1 to SF14. In addition, in a third gradation expressing luminance one level higher than the second gradation, a selective writing address discharge is only generated in the subfield SF2 among the subfields SF1 to SF14. As a result, a single sustain discharge is generated in the form of a discharge involved with a display image in only the subfield SF2 among subfields SF1 to SF14. In a fourth gradation and beyond, a selective writing address discharge is generated in each subfield SF1 and SF2, and selective writing address discharges are generated in each of a number of continuous subfields corresponding to that gradation. As a result, following the generation of a microemission discharge in subfield SF1, sustain discharges are generated in each of a number of continuous subfields corresponding to that gradation in the form of discharges involved with a display image.

According to this driving, halftone luminance can be displayed for (N+1) gradations (N: number of subfields in the display period of one field) similar to FIG. 6. Furthermore, depending on the manner in which those subfields in which a selective writing address discharge is to be generated in the display period of one field are combined, halftone luminance can also be expressed for $2^N$ gradations (N: number of subfields in the display period of one field) based on the driving shown in FIGS. 12 and 13. Namely, in the case of 14 subfields SF1 to SF14, since there are $2^{14}$ patterns in which subfields in which a selective writing address discharge is generated can be combined, halftone luminance can be displayed for 16384 gradations.

According to the driving shown in FIG. 13, since reset pulse $RP1_{Y2}$ or $RP2_{Y2}$ applied to the row electrodes Y in the first reset step R1 or the second reset step R2 and elimination pulse EP applied to the row electrodes Y in the elimination step E have the same waveform, both can be generated with a common circuit. Moreover, since only selective writing address steps (W1$w$, W2$w$) are employed as a method for setting the status of the discharge cells PC (on mode, off mode) in each subfield SF1 to SF14, only one circuit is required for generating a scanning pulse. Furthermore, a general column-side anode discharge using the column electrodes as the anode is generated in the selective writing address steps.

Accordingly, in the driving of the PDP 50, in the case of employing driving as shown in FIGS. 12 and 13, panel drivers for generating each drive pulse can be constructed less expensively as compared with driving as shown in FIGS. 7 and 8.

Figure 14:
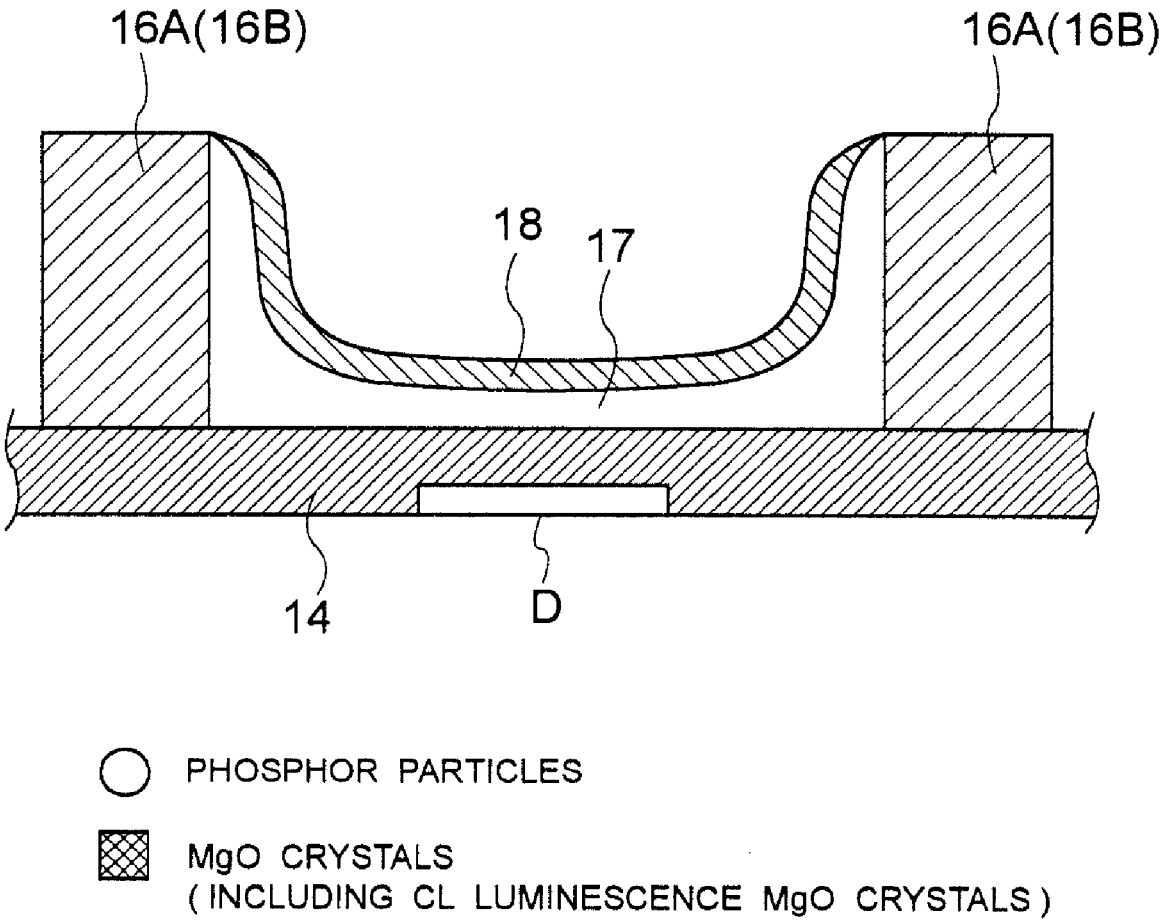
FIG. 14 schematically shows a mode in the case of constructing by overlapping a secondary electron release layer 18 on the surface of the phosphor layer 17.

Furthermore, although MgO crystals are contained in the phosphor layer 17 provided on rear substrate 14 of the PDP 50 in the embodiment shown in FIG. 5, as shown in FIG. 14, a secondary electron releasing layer 18 composed of a secondary electron releasing material may also be provided to as to cover the surface of the phosphor layer 17. At this time, the secondary electron releasing layer 18 may be formed by packing crystals composed of a secondary electron releasing material (such as MgO crystals including CL luminescence MgO crystals) on the surface of the phosphor layer 17, or the secondary electron releasing material may be formed by depositing in the form of a thin film.

Figure 15:
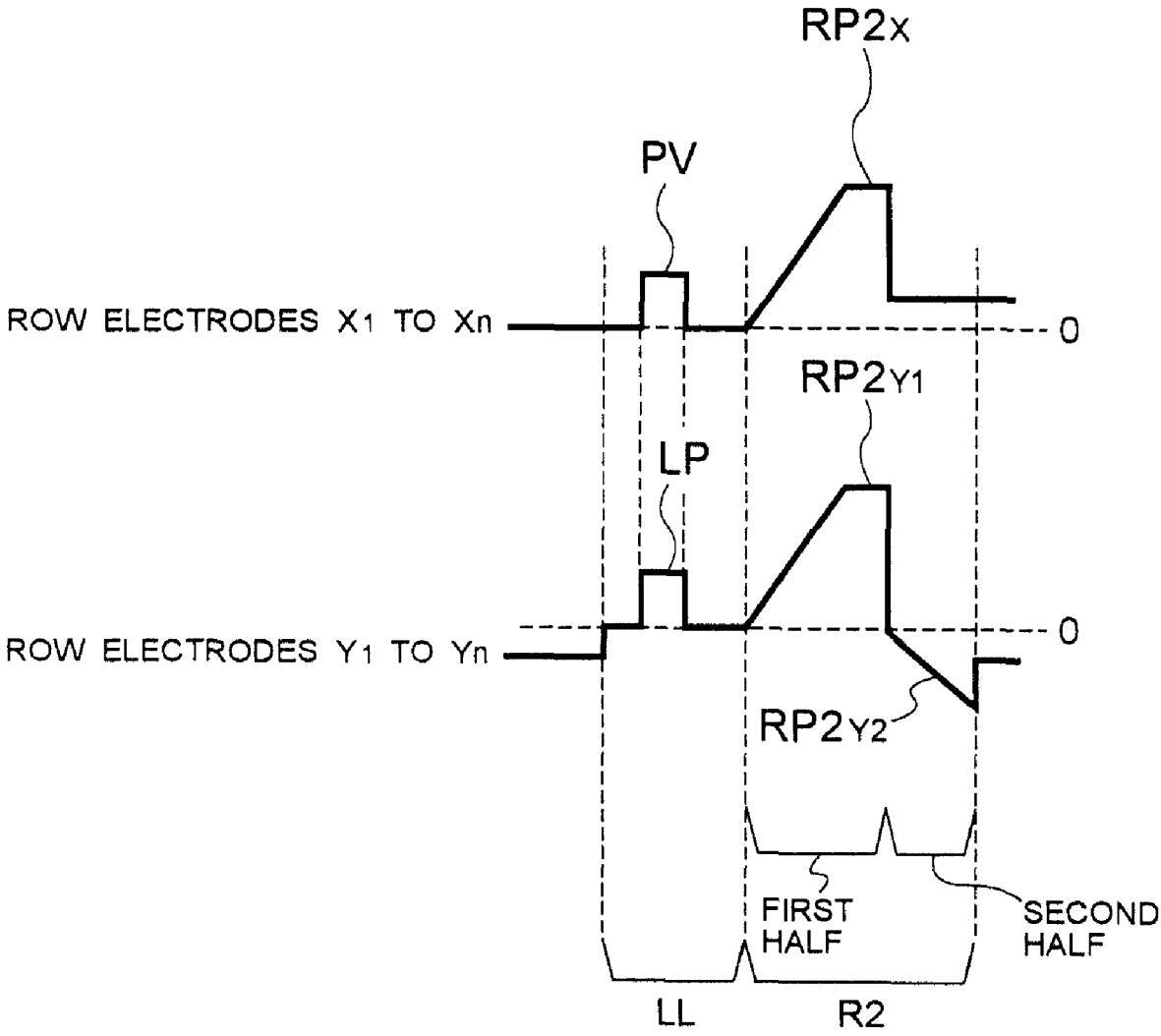
FIG. 15 shows another example of the respective application timing of a microemission pulse LP and a reset pulse $RP_{Y2}$.

In addition, although microemission pulse LP and reset pulse $RP2_{Y1}$ are collectively applied to the row electrodes Y in the embodiment shown in FIGS. 8 and 13, as shown in FIG. 15, both pulses may be applied sequentially to the row electrodes Y by distributing over time.

In addition, although reset steps (R1, R2) and selective writing address steps (W1$w$, W2$w$) are sequentially executed in only the first subfield SF1 and the second subfield SF2 in the above-mentioned embodiment, this series of operations may also be similarly executed in the third subfield and beyond.

In addition, microemission step LL is executed instead of sustain step I as the step for carrying out luminescence involving a display image in the above-mentioned embodiment, but only in the first subfield SF1. However, microemission step LL may also be executed instead of sustain step I in a subfield other than the first subfield or in a plurality of subfields including the first subfield.

In addition, although a reset discharge is generated en bloc for all discharge cells in reset step R shown in FIGS. 8 and 13, individual reset discharges may also be executed distributed over time for each discharge cell block composed of a plurality of discharge cells.

In addition, in the case of driving as shown in FIG. 6, although a microemission discharge is generated accompanying luminescence of a luminance level α in the subfield SF1 for gradations starting with the fourth gradation and beyond, a microemission discharge may also be made to not be generated starting with the third gradation. In other words, since luminescence accompanying microemission discharge has an extremely low luminance (luminance level α), in the case of using in combination with a sustain discharge accompanying luminescence of higher luminance, namely in the case of being unable to visualize the increase in luminance of "luminance level α" starting with the third gradation, it is no longer necessary to generate this microemission discharge.

This application is based on Japanese Patent Application No. 2006-291274 which is hereby incorporated by reference.

What is claimed is:

1. A method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, the method comprising:

sequentially executing a reset step, in which the display cells are initialized to a state of an OFF mode by generating a reset discharge between ones of the row electrodes of the row electrode pairs and the column electrodes within the display cells by applying a voltage, using ones of the row electrodes of the row electrode pairs as the anode and the column electrodes as the cathode, between the ones of the row electrodes and the column electrodes, and an address step, in which the display cells are changed to a state of an ON mode by causing the display cells to selectively address discharge, corresponding to the pixel data, said reset step and said address step being executed in at least a first subfield and a second subfield immediately following the first subfield when a display period of a single field in the video signal is divided into a plurality of subfields;

executing a sustain step that causes a sustain discharge in only the display cells in the state of the ON mode by alternately applying a sustain pulse to the ones of the row electrode pairs and the others of the row electrode pairs in each subfield subsequent to the second subfield; and executing a microemission step, in which a microemission discharge is generated between the ones of the row electrodes and the column electrodes within the display cells in the state of the ON mode by applying a voltage, using the ones of the row electrodes as the anode and the column electrodes as the cathode, between the ones of the row electrodes and the column electrodes while respectively applying a potential lower than the voltage generated between the ones of the row electrodes and the others of the row electrodes to the ones of the row electrodes and the others of the row electrodes when applying the sustain pulse immediately after the address step in the first subfield.

2. The method for driving a plasma display panel according to claim 1, wherein voltages of a positive polarity are applied respectively to the ones of the row electrodes and the others of the row electrodes in the microemission step.

3. The method for driving a plasma display panel according to claim 1, wherein a potential by which the voltage between the ones of the row electrodes and the others of the row electrodes is made smaller than a discharge starting voltage is respectively applied to the ones of the row electrodes and the others of the row electrodes in the microemission step.

4. The method for driving a plasma display panel according to claim 1, wherein the same potential is applied to the ones of the row electrodes and the others of the row electrodes in the microemission step.

5. The method for driving a plasma display panel according to claim 1, wherein the microemission discharge is a discharge accompanying luminescence corresponding to a gradation one level higher than a gradation level 0.

6. The method for driving a plasma display panel according to claim 1, wherein, in the reset step of the second subfield, the reset discharge is generated by gradually increasing over time the potential applied to the ones of the row electrodes to generate the microemission discharge in the microemission step.

7. The method for driving a plasma display panel according to claim 1, wherein the rate of change over time during the rise interval of a potential applied to the one of the row electrodes to generate the microemission discharge in the microemission step is greater than the rate of change over time in the rise interval of a potential applied to the ones of the row electrodes to generate the reset discharge in the reset step of the second subfield.

8. The method for driving a plasma display panel according to claim 1, wherein a potential applied to the ones of the row electrodes to generate the microemission discharge in the microemission step is lower than the peak potential of the sustain pulse.

9. The method for driving a plasma display panel according to claim 1, wherein a phosphor layer, which emits light accompanying a discharge generated in the discharge space, is provided on a protective layer formed so as to cover the row electrodes on the second substrate, and a secondary electron releasing material is contained in the phosphor layer.

10. The method for driving a plasma display panel according to claim 9, wherein the secondary electron releasing material comprise magnesium oxide.

11. The method for driving a plasma display panel according to claim 10, wherein the magnesium oxide contains magnesium oxide crystals that exhibit cathode luminescence having a peak within a wavelength range of 200 to 300 nm, as a result of being excited by electron beam irradiation.

12. The method for driving a plasma display panel according to claim 11, wherein the magnesium oxide crystals are formed by vapor phase oxidation.

13. The method for driving a plasma display panel according to claim 11, wherein the magnesium oxide crystals exhibit cathode luminescence having a peak within a wavelength range of 230 to 250 nm.

14. The method for driving a plasma display panel according to claim 9, wherein particles formed of the secondary electron releasing material in the discharge space are contacted with the discharge gas.

15. A method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, the method comprising:

sequentially executing a reset step, in which the display cells are initialized to a state of an OFF mode by generating a reset discharge of the display cells, an address step, in which the display cells are changed to a state of an ON mode by causing the display cells to selectively address discharge corresponding to the pixel data, and a microemission step, in which the display cells in the state of the ON mode are caused to microemission discharge, said reset step, said address step and said microemission step being executed in a first subfield when a display period of a single field in the video signal is divided into a plurality of subfields, wherein in the reset step, the reset discharge is generated between ones of the row electrodes of the row electrode pairs and the column electrodes by applying a voltage, using the ones of the row electrodes as the anode and the column electrodes as the cathode, between the one of the row electrodes and the column electrodes, and in the microemission step, together with generating the microemission discharge between the column electrodes and the ones of the row electrodes in the display cells in the state of the ON mode by applying a voltage, using the ones of the row electrodes as the anode and the column electrodes as the cathode, between the ones of the row electrodes and the column electrodes, a potential of the same polarity as a potential applied to the ones of the row electrodes is applied to the others of the row electrodes of the row electrode pairs.

16. The method for driving a plasma display panel according to claim 15, wherein the microemission discharge is a discharge accompanying luminescence corresponding to a gradation one level higher than a gradation level 0.

17. A method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, the method comprising:

sequentially executing a reset step in which a voltage, of ones of the row electrodes of the row electrode pairs that are used as the anode and the column electrodes that are used as the cathode, is applied between the ones of the row electrodes and the column electrodes, and an address step in which pixel data pulses are applied to said column electrodes according to the pixel data, said reset step and said address step being executed in at least a first subfield and a second subfield immediately following the first subfield when a display period of a single field in the video signal is divided into a plurality of subfields;

executing a sustain step in which a sustain pulse is alternately applied to the ones of the row electrode pairs and the others of the row electrode pairs in each subfield subsequent to the second subfield; and executing a microemission step, in which a voltage, of the ones of the row electrodes that are used as the anode and the column electrodes that are used as the cathode, is applied between the ones of the row electrodes and the column electrodes while respectively applying a potential lower than the voltage generated between the ones of the row electrodes and the others of the row electrodes to the ones of the row electrodes and the others of the row electrodes when applying the sustain pulse immediately after the address step in the first subfield.

18. A method for driving a plasma display panel, in which a first substrate and a second substrate are arranged in opposition with a discharge space having a discharge gas sealed therein positioned between the first substrate and the second substrate, and in which display cells are formed at each intersection of a plurality of row electrode pairs formed on the first substrate and a plurality of column electrodes formed on the second substrate, the plasma display panel being driven corresponding to pixel data of each pixel based on a video signal, the method comprising:

sequentially executing a reset step in which a voltage, of ones of the row electrodes of the row electrode pairs that are used as the anode and the column electrodes that are used as the cathode, is applied between the ones of the row electrodes and the column electrodes, and an address step in which pixel data pulses are applied to said column electrodes according to the pixel data, said reset step and said address step being executed in at least a first subfield when a display period of a single field in the video signal is divided into a plurality of subfields; and executing a microemission step, in which a voltage, of the ones of the row electrodes that are used as the anode and the column electrodes that are used as the cathode, is applied between the ones of the row electrodes and the column electrodes in said first subfield, wherein a potential applied to said ones of the row electrodes in said microemission step is lower than a potential applied to said ones of the row electrodes in said reset step.

19. A method for driving a plasma display panel as claimed in claim 2, wherein a potential applied to said ones of the row electrodes in said microemission step is higher than a potential applied to said ones of the row electrodes in said address step.

* * * * *